US011791085B2

(12) United States Patent
Yoshioka et al.

(10) Patent No.: US 11,791,085 B2
(45) Date of Patent: Oct. 17, 2023

(54) INDUCTOR COMPONENT

(71) Applicant: Murata Manufacturing Co., Ltd., Kyoto (JP)

(72) Inventors: Yoshimasa Yoshioka, Nagaokakyo (JP); Mizuho Katsuta, Nagaokakyo (JP); Kouji Yamauchi, Nagaokakyo (JP); Ryo Kudou, Nagaokakyo (JP); Naoya Noo, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 815 days.

(21) Appl. No.: 16/503,298

(22) Filed: Jul. 3, 2019

(65) Prior Publication Data

US 2020/0027645 A1 Jan. 23, 2020

(30) Foreign Application Priority Data

Jul. 17, 2018 (JP) ..... 2018-134185

(51) Int. Cl.
*H01F 27/28* (2006.01)
*H01F 27/255* (2006.01)
(Continued)

(52) U.S. Cl.
CPC ..... *H01F 27/2804* (2013.01); *H01F 27/255* (2013.01); *H01F 27/323* (2013.01);
(Continued)

(58) Field of Classification Search
CPC .. H01F 27/2804; H01F 27/255; H01F 27/323; H01F 41/041; H01F 41/122; H01F 2027/2809; H01F 2017/0066; H01F 2017/0073; H01F 17/0013; H01F 27/24; H01F 27/263; H01F 27/28
(Continued)

(56) References Cited

U.S. PATENT DOCUMENTS 10,014,102 B2 7/2018 Choi et al.
10,453,602 B2 10/2019 Yoshioka et al.
(Continued)

FOREIGN PATENT DOCUMENTS

CN 103165278 A 6/2013
CN 103578708 A 2/2014
(Continued)

OTHER PUBLICATIONS

An Office Action; "Notice of Reasons for Refusal," mailed by the Japanese Patent Office dated Feb. 9, 2021, which corresponds to Japanese Patent Application No. 2018-134185 and is related to U.S. Appl. No. 16/503,298 with English language translation.
(Continued)

*Primary Examiner* — Shawki S Ismail
*Assistant Examiner* — Kazi S Hossain
(74) *Attorney, Agent, or Firm* — Studebaker & Brackett PC

(57) ABSTRACT

An inductor component comprising a first magnetic layer and a second magnetic layer containing a resin, a substrate of a sintered body having a first principal surface in close contact with the first magnetic layer and a second principal surface above which the second magnetic layer is disposed, and a spiral wiring disposed between the second magnetic layer and the substrate.

18 Claims, 12 Drawing Sheets

(51) Int. Cl.
*H01F 41/04* (2006.01)
*H01F 41/12* (2006.01)
*H01F 27/32* (2006.01)

(52) U.S. Cl.
CPC ..... *H01F 41/041* (2013.01); *H01F 41/122* (2013.01); *H01F 2027/2809* (2013.01)

(58) Field of Classification Search
USPC ..... 336/200, 232, 198, 192
See application file for complete search history.

(56) References Cited

U.S. PATENT DOCUMENTS

| | | | | |
|---|---|---|---|---|
| 2001/0024739 | A1 | 9/2001 | Mizoguchi et al. | |
| 2010/0176909 | A1 | 7/2010 | Yasuda et al. | |
| 2013/0154785 | A1* | 6/2013 | Yokoyama | H01F 41/046 336/200 |
| 2014/0022041 | A1* | 1/2014 | Park | H01F 5/00 336/199 |
| 2015/0091688 | A1* | 4/2015 | Jung | H01F 17/0006 336/200 |
| 2016/0336107 | A1* | 11/2016 | Choi | H01F 41/042 |
| 2017/0004917 | A1* | 1/2017 | Yang | C23F 1/02 |
| 2018/0277296 | A1* | 9/2018 | Endo | H01F 27/292 |
| 2019/0244743 | A1* | 8/2019 | Hirai | H01F 17/0013 |

FOREIGN PATENT DOCUMENTS

| | | | |
|---|---|---|---|
| CN | 104575935 | A | 4/2015 |
| CN | 107818864 | A | 3/2018 |
| JP | 2001-244123 | A | 9/2001 |
| JP | 2001-244124 | A | 9/2001 |
| JP | 2007-305824 | A | 11/2007 |
| JP | 2010-027758 | A | 2/2010 |
| JP | 2013-125819 | A | 6/2013 |
| JP | 2013-225718 | A | 10/2013 |
| JP | 2014-022724 | A | 2/2014 |
| JP | 2015-076603 | A | 4/2015 |
| JP | 2016-146431 | A | 8/2016 |
| JP | 2017-199801 | A | 11/2017 |
| JP | 2018-046051 | A | 3/2018 |

OTHER PUBLICATIONS

An Office Action mailed by China National Intellectual Property Administration dated Jan. 4, 2022 which corresponds to Chinese Patent Application No. 201910609095.X and is related to U.S. Appl. No. 16/503,298 with English language translation.

* cited by examiner

INDUCTOR COMPONENT

CROSS REFERENCE TO RELATED APPLICATION

This application claims benefit of priority to Japanese Patent Application 2018-134185 filed Jul. 17, 2018, the entire content of which is incorporated herein by reference.

BACKGROUND

Technical Field

The present disclosure relates to an inductor component.

Background Art

A conventional inductor component is described in Japanese Laid-Open Patent Publication No. 2013-225718. This inductor component includes an insulating substrate, a spiral conductor formed on a principal surface of the insulating substrate, an insulating layer containing no magnetic substance covering the spiral conductor, an upper magnetic layer and a lower magnetic layer covering the upper-surface side and the back-surface side of the insulating substrate, and a pair of terminal electrodes. The insulating substrate is a general printed circuit board material in which a glass cloth is impregnated with epoxy resin, and the size of the insulating substrate is 2.5 mm×2.0 mm×0.3 mm. The upper magnetic layer and the lower magnetic layer are made of a resin containing a metal magnetic powder.

An inductor component described in Japanese Laid-Open Patent Publication No. 2007-305824 includes a sheet-shaped element body, a planar coil constituting a coil formed in the element body, and a terminal formed in an outermost circumferential portion of the coil. The element body is a laminated body of insulating layers using photoresist. The terminal is partially made of a magnetic substance. A magnetic center-leg part made of a magnetic substance is formed in an inner circumferential direction of the coil in the element body. This inductor component is formed by laminating the element body etc. on a substrate of silicon etc. and then removing the substrate by a hydrofluoric acid treatment etc.

SUMMARY

In Japanese Laid-Open Patent Publication No. 2013-225718, since the spiral conductor is formed on both surfaces of the insulating substrate, the insulating substrate cannot be processed after spiral conductor is formed. Therefore, if the thickness of the insulating substrate (specifically 0.3 mm) is ensured for stably forming a laminated object such as the spiral conductor, this makes it difficult to reduce a height of an inductor component, and on the other hand, if the thickness of the insulating substrate is set such that the inductor component can be reduced in height, this makes it difficult to stably form a laminated object such as the spiral conductor. Therefore, it is difficult to satisfy both the workability and the height reduction of the inductor component.

In Japanese Laid-Open Patent Publication No. 2007-305824, since the substrate is removed after a laminated object such as an element body is formed on the substrate, the trade-off between the workability and the height reduction is improved as compared to Japanese Laid-Open Patent Publication No. 2013-225718. However, a process of removing the substrate is likely to remove a portion of a remaining laminated object side so as to completely eliminate the residue of the substrate, which may cause, for example, a decrease in strength and insulation due to partial removal of the element body, a decrease in DC electrical resistance (Rdc) due to partial removal of the planar coil, and a decrease in inductance (L) due to partial removal of the magnetic material terminal and the magnetic center-leg part. Furthermore, a removal amount on the laminated object side may vary in each removal process at the time of mass production, which may increase mass-production variations in the strength, insulation, Rdc, L, component height dimension, etc.

As described above, it cannot be said that the conventional inductor components have a configuration suitably reduced in size and height.

Therefore, the present disclosure provides an inductor component suitably reduced in size and height.

Accordingly, an aspect of the present disclosure provides an inductor component comprising a first magnetic layer and a second magnetic layer containing a resin, a substrate of a sintered body having a first principal surface in close contact with the first magnetic layer and a second principal surface above which the second magnetic layer is disposed, and a spiral wiring disposed between the second magnetic layer and the substrate.

As used herein, the phrase "in close contact" refers to a configuration in which constituent elements are in contact with each other without another constituent element interposed therebetween and, for example, in the above description, refers to a configuration in which the first principal surface of the substrate is in direct contact with the first magnetic layer. Additionally, the term "above" refers to a configuration in which one of the constituent elements is located on the upper side, including both the case that the constituent elements are in close contact with each other as described above and the case that another constituent element is interposed therebetween, and, for example, in the above description, the second principal surface may be in direct contact with the second magnetic layer or another constituent element may be interposed between the second principal surface and the second magnetic layer.

According to the inductor component of the present disclosure, laminated objects such as the second magnetic layer and the spiral wiring above the second principal surface can be formed on the second principal surface of the stable substrate that is a sintered body, and therefore, the formation accuracy of the laminated objects can be improved. Since the first principal surface of the substrate is in close contact with the first magnetic layer, the spiral wiring is not formed on the first principal surface. Therefore, even if the thickness of the substrate is ensured to some extent so as to improve the formation accuracy of the laminated objects, the substrate can be processed by polishing etc. from the first principal surface side, so that the thickness can be reduced after the laminated objects are formed on the second principal surface. Therefore, both the formation accuracy and the height reduction of the inductor component can be achieved.

Additionally, since the substrate is not completely removed, the laminated objects such as the spiral wiring can be protected from the processing, and mass-production variations in Rdc etc. can be suppressed.

Furthermore, by adding a processing amount of the substrate as an adjustment element to a manufacturing process, a degree of design freedom can be improved in terms of the strength, L, height dimension, etc. of the inductor component, and the mass-production variations thereof can be reduced.

The spiral wiring means a curve (two-dimensional curve) extending on a plane, may be a curve having the number of turns exceeding one or may be a curve having the number of turns less than one, or may have a portion that is a straight line.

In an embodiment of the inductor component, the substrate is a magnetic substance. According to the embodiment, a region of the magnetic substance is increased in the inductor component, so that L can be improved.

In an embodiment of the inductor component, the first magnetic layer and the second magnetic layer contain a metal magnetic powder contained in the resin, and the substrate is a sintered body of ferrite. According to the embodiment, DC superimposition characteristics can be improved by the first magnetic layer and the second magnetic layer containing the metal magnetic powder.

In an embodiment of the inductor component, the first magnetic layer and the second magnetic layer further contain a ferrite powder. According to the embodiment, the effective magnetic permeability, i.e., the magnetic permeability per volume of the first and second magnetic layers, can be improved by containing the ferrite having a high relative magnetic permeability.

In an embodiment of the inductor component, a sum of the thickness of the first magnetic layer and the thickness of the second magnetic layer is larger than the thickness of the substrate. According to the embodiment, since the proportion of the magnetic layers containing a resin becomes large, the stress absorbability of the inductor component is improved, and the reliability is improved. Additionally, if the first magnetic layer and second magnetic layer contain the metal magnetic powder, the DC superimposition characteristics of the inductor component can be improved.

In an embodiment of the inductor component, the thickness of the first magnetic layer and the thickness of the second magnetic layer are both larger than the thickness of the substrate. According to the embodiment, since the proportion of the magnetic layers containing a resin becomes larger, the stress absorbability of the inductor component is further improved, and the reliability is further improved. Additionally, if the first magnetic layer and second magnetic layer contain the metal magnetic powder, the DC superimposition characteristics of the inductor component can further be improved.

In an embodiment of the inductor component, the electrical resistivity of the first magnetic layer and the electrical resistivity of the second magnetic layer are higher than the electrical resistivity of the substrate. According to the embodiment, an iron loss, i.e., a loss due to a material, can be reduced by including a portion having a high electrical resistivity. In the above description, the electrical resistivities of the first magnetic layer, the second magnetic layer, and the substrate are based on the product of an electrical resistance per unit length at 1.0 V and a cross-sectional area.

In an embodiment of the inductor component, a side surface connecting the first principal surface and the second principal surface of the substrate is at least partially covered with the first magnetic layer or the second magnetic layer. According to the embodiment, since the proportion of the magnetic layers containing a resin becomes larger, the stress absorbability of the inductor component is improved, and the reliability is improved. Additionally, if the first magnetic layer and second magnetic layer contain the metal magnetic powder, the DC superimposition characteristics of the inductor component can be improved.

In an embodiment of the inductor component, the substrate has a crack portion. According to the embodiment, a stress is released in the crack portion, and the impact resistance of the inductor component is improved.

In an embodiment of the inductor component, the inductor component further comprises an insulating layer disposed on the second principal surface of the substrate, and the spiral wiring is formed on the insulating layer. According to the embodiment, the insulation of the spiral wiring is improved.

In an embodiment of the inductor component, the inductor component further comprises a second insulating layer disposed on the insulating layer, and the spiral wiring is covered with the second insulating layer. According to the embodiment, the insulation of the spiral wiring is further improved. The insulating layer and the second insulating layer may be integrated.

In an embodiment of the inductor component, the spiral wiring is disposed on the second principal surface of the substrate. According to the embodiment, since no other constituent element such as the insulating layer is interposed between the spiral wiring and the second principal surface of the substrate, the characteristics such as L and Rdc can be improved in the same volume or the height can be reduced while maintaining the same characteristics.

In an embodiment of the inductor component, the spiral wiring includes a spiral-shaped first conductor layer and a second conductor layer disposed on the first conductor layer and shaped along the first conductor layer, and the first conductor layer has a thickness of 0.5 μm or more. According to the embodiment, the unevenness of the substrate can be absorbed by the thickness of the first conductor layer, and the formation and processing of the second conductor layer is facilitated, so that the formation accuracy of the inductor component is improved.

In an embodiment of the inductor component, the spiral wiring includes a spiral-shaped first conductor layer and a second conductor layer disposed on the first conductor layer and shaped along the first conductor layer, and the first conductor layer has a Ni content percentage of 5.0 wt % or less. According to the embodiment, a difference can be reduced between the electric conductivity of the first conductor layer and the electric conductivity of the second conductor layer, and the current flowing through the spiral wiring flows substantially uniformly in cross sections of the first conductor layer and the second conductor layer, so that heat generation can be made uniform in the spiral wiring. Additionally, Rdc of the spiral wiring is reduced.

In an embodiment of the inductor component, the spiral wiring includes a spiral-shaped first conductor layer and a second conductor layer disposed on the first conductor layer and shaped along the first conductor layer, and a taper angle of a side surface of the first conductor layer is larger than a taper angle of a side surface of the second conductor layer. According to the embodiment, the filling property of the second magnetic layer is improved on the side surface of the spiral wiring.

In an embodiment of the inductor component, the spiral wiring is one of a plurality of spiral wirings arranged in a lamination direction, and the plurality of spiral wirings is connected in series. According to the embodiment, L can be improved.

In an embodiment of the inductor component, the spiral wiring is one of a plurality of spiral wirings disposed on the same plane, and the spiral wirings adjacent to each other on the same plane include side surfaces facing each other. The side surfaces are at least partially in contact with the second magnetic layer, and an insulating layer is disposed between the spiral wirings adjacent to each other. According to the embodiment, the insulation and voltage resistance between the adjacent spiral wirings are improved.

In an embodiment of the inductor component, the spiral wiring includes an exposed portion exposed to the outside from a side surface parallel to the lamination direction of the inductor component. According to the embodiment, since the spiral wiring includes the exposed portion, a resistance to electrostatic destruction can be improved at the time of manufacturing.

In an embodiment of the inductor component, a thickness of an exposed surface of the exposed portion is equal to or less than the thickness of the spiral wiring and is 45 μm or more. According to the embodiment, since the thickness of the exposed surface is equal to or less than the thickness of the spiral wirings, the proportion of the magnetic layers can be increased, and L can be improved. Additionally, since the thickness of the exposed surface is 45 μm or more, occurrence of disconnection can be reduced.

In an embodiment of the inductor component, the exposed surface is an oxide film. According to the embodiment, a short circuit can be suppressed between the inductor component and the adjacent component.

According to the inductor component of an aspect of the present disclosure, the inductor component suitably reduced in size and height can be achieved.

DETAILED DESCRIPTION

An inductor component of an aspect of the present disclosure will now be described in detail with reference to shown embodiments. The drawings include schematics and may not reflect actual dimensions or ratios.

First Embodiment (Configuration)

Figure 1A:
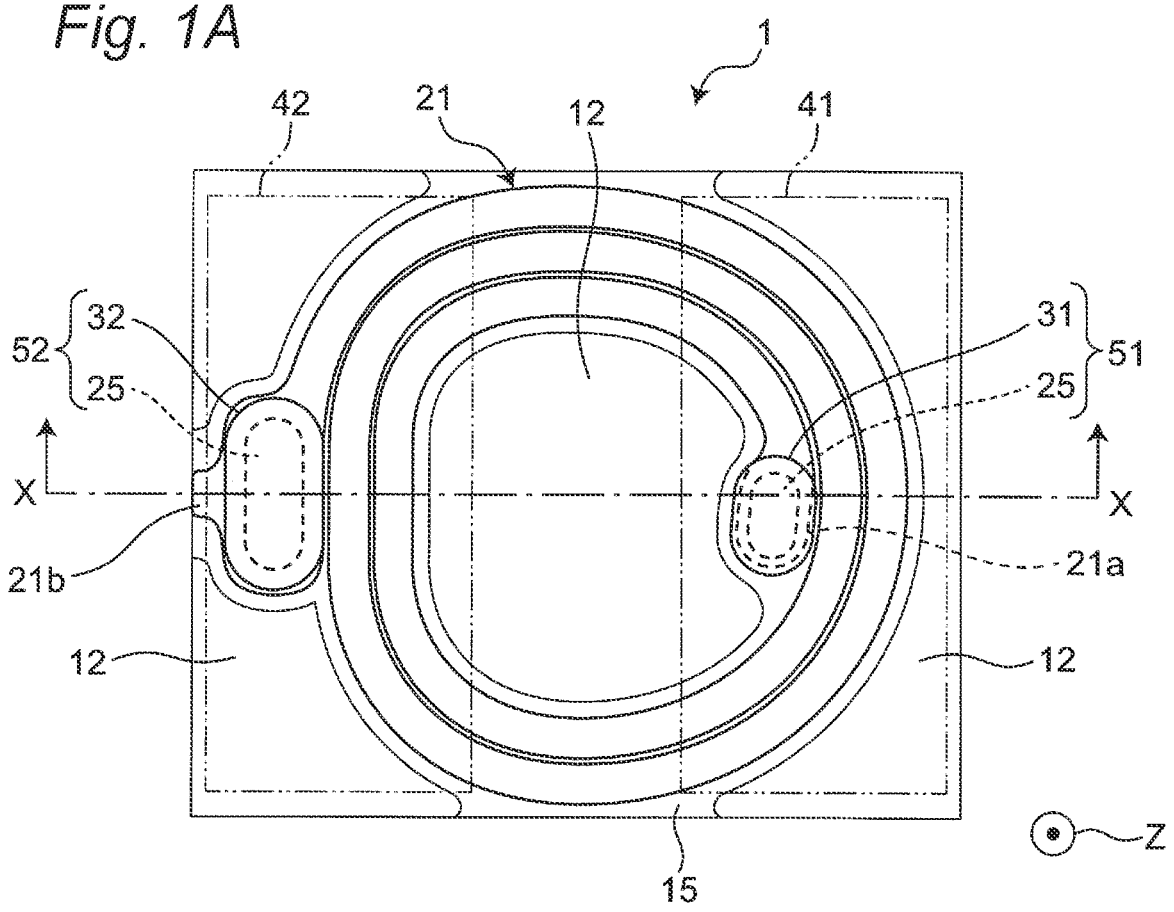
FIG. 1A is a transparent plan view showing an inductor component according to a first embodiment.
Figure 1B:
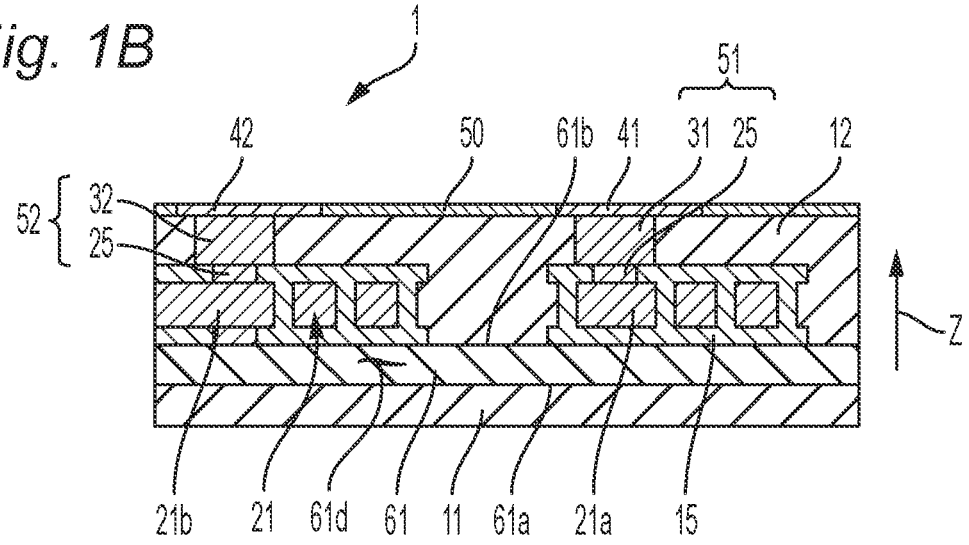
FIG. 1B is a cross-sectional view showing the inductor component according to the first embodiment.

FIG. 1A is a transparent plan view showing a first embodiment of an inductor component. FIG. 1B is a cross-sectional view taken along a line X-X of FIG. 1A.

An inductor component 1 is mounted on an electronic device such as a personal computer, a DVD player, a digital camera, a TV, a portable telephone, a smartphone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1A and 1B, the inductor component 1 has a substrate 61, a first magnetic layer 11, a second magnetic layer 12, an insulating layer 15, a spiral wiring 21, vertical wirings 51, 52, external terminals 41, 42, and a coating film 50.

The substrate 61 has a flat plate shape and is a portion serving as a base for a manufacturing process of the inductor component 1. The substrate 61 includes a first principal surface 61*a* as a lower surface and a second principal surface 61*b* as an upper surface. A normal direction relative to the principal surfaces 61*a*, 61*b* is defined as a Z direction (up-down direction) in the figures, and in the following description, it is assumed that a forward Z direction faces toward the upper side while a reverse Z direction faces toward the lower side. The Z direction is the same in the other embodiments and examples.

The substrate 61 is polished on the first principal surface 61*a* side, and the thickness of the substrate 61 is 5 μm or more and 100 μm or less (i.e., from 5 μm to 100 μm), for example. For example, the substrate 61 is preferably a sintered body of a magnetic substrate made of NiZn- or MnZn-based ferrite or a nonmagnetic substrate made of alumina or glass. As a result, the strength and flatness of the substrate 61 can be ensured, and a workability of a laminated object on the substrate 61 is improved.

The spiral wiring 21 is formed only on the upper side of the substrate 61, or specifically, on the insulating layer 15 on the second principal surface 61*b* of the substrate 61 and is a wiring extending in a spiral shape along the second principal surface 61*b* of the substrate 61. The spiral wiring 21 has a spiral shape with the number of turns exceeding one. The spiral wiring 21 is spirally wound in a clockwise direction from an outer circumferential end 21*b* toward an inner circumferential end 21*a* when viewed from the upper side, for example.

The thickness of the spiral wiring 21 is preferably 40 μm or more and 120 μm or less, for example. An example of the spiral wiring 21 has a thickness of 45 μm, a wiring width of 50 μm, and an inter-wiring space of 10 μm. The inter-wiring space is preferably 3 μm or more and 20 μm or less (i.e., from 3 μm to 20 μm).

The spiral wiring 21 is made of a conductive material and is made of a metal material having a low electric resistance such as Cu, Ag, and Au, for example. In this embodiment, the inductor component 1 includes only one layer of the spiral wiring 21, so that the inductor component 1 can be reduced in height. Specifically, the spiral wiring 21 has both ends (the inner circumferential end 21*a* and the outer circumferential end 21*b*) provided with pad portions having a line width slightly larger than a spiral-shaped portion and is directly connected at the pad portions to the vertical wirings 51, 52.

The insulating layer 15 is a film-shaped layer formed on the second principal surface 61*b* of the substrate 61 and covers the spiral wiring 21. Specifically, the insulating layer 15 entirely covers bottom and side surfaces of the spiral wiring 21 and covers an upper surface of the spiral wiring 21 in portions other than connecting portions to via conductors 25. The insulating layer 15 has a hole portion at a position corresponding to an inner circumferential portion of the spiral wiring 21. The thickness of the insulating layer 15 between the substrate 61 and the bottom surface of the spiral wiring 21 is 10 μm or less, for example.

The insulating layer 15 is made of an insulating material containing no magnetic substance and is made of, for example, a resin material such as an epoxy resin, a phenol resin, a polyimide resin. The insulating layer 15 may contain a filler of a nonmagnetic substance such as silica and, in this case, the insulating layer 15 can be improved in the strength, workability, and electrical characteristics.

The first magnetic layer 11 is in close contact with the first principal surface 61*a* of the substrate 61. The second magnetic layer 12 is disposed above the second principal surface 61*b* of the substrate 61. The spiral wiring 21 is disposed between the second magnetic layer 12 and the substrate 61. In this embodiment, the second magnetic layer 12 is formed along the insulating layer 15 to cover not only the upper side of the spiral wiring 21 but also the inner and outer circumferential portions of the spiral wiring 21.

The first magnetic layer 11 and the second magnetic layer 12 contain a resin containing a powder of a magnetic material. The resin is, for example, an epoxy resin, a phenol resin, a polyimide resin, an acrylic resin, a phenol resin, a vinyl ether resin, and a mixture thereof. The powder of the magnetic material is, for example, a powder of metal magnetic material including an FeSi alloy such as FeSiCr, an FeCo alloy, an Fe alloy such as NiFe, or an amorphous alloy thereof, or a powder of NiZn- or MnZn-based ferrite etc. The content percentage of the magnetic material is preferably 50 vol % or more and 85 vol % or less (i.e., from 50 vol % to 85 vol %) relative to the whole magnetic layer. The powder of the magnetic material preferably has particles of substantially spherical shape, and the average particle diameter is preferably 5 μm or less. The resin constituting the first and second magnetic layers 11, 12 is preferably the same type of material as the insulating layer 15, and in this case, the adhesion between the insulating layer 15 and the first and second magnetic layers 11, 12 can be improved.

The vertical wirings 51, 52 are made of a conductive material, extend from the spiral wiring 21 in the Z direction, and penetrate the inside of the second magnetic layer 12. The vertical wirings 51, 52 include the via conductors 25 extending from the spiral wiring 21 in the Z direction and penetrating the inside of the insulating layer 15 and columnar wirings 31, 32 extending from the via conductors 25 and penetrating the inside of the second magnetic layer 12.

The first vertical wiring 51 includes the via conductor 25 extending upward from the upper surface of the inner circumferential end 21*a* of the spiral wiring 21 and the first columnar wiring 31 extending upward from the via conductor 25 and penetrating the inside of the first magnetic layer 11. The second vertical wiring 52 includes the via conductor 25 extending upward from the upper surface of the outer circumferential end 21*b* of the spiral wiring 21 and the second columnar wiring 31 extending upward from the via conductor 25 and penetrating the inside of the first magnetic layer 11. The vertical wirings 51, 52 are made of the same material as the spiral wiring 21.

The external terminals 41, 42 are made of a conductive material and has, for example, a three-layer configuration with Cu having low electric resistance and excellent in stress resistance, Ni excellent in corrosion resistance, and Au excellent in solder wettability and reliability arranged in this order from the inside to the outside.

The first external terminal 41 is disposed on the upper surface of the second magnetic layer 12 and covers an end surface of the first columnar wiring 31 exposed from the upper surface. As a result, the first external terminal 41 is electrically connected to the inner circumferential end 21*a* of the spiral wiring 21. The second external terminal 42 is disposed on the upper surface of the second magnetic layer 12 and covers an end surface of the second columnar wiring 32 exposed from the upper surface. As a result, the second external terminal 42 is electrically connected to the outer circumferential end 21*b* of the spiral wiring 21.

Preferably, a rust prevention treatment is applied to the external terminals 41, 42. This rust prevention treatment refers to coating with Ni and Au, or Ni and Sn, etc. This enables the suppression of copper leaching due to solder and the rusting so that the inductor component 1 with high mounting reliability can be provided.

The coating film 50 is made of an insulating material and covers the upper surface of the second magnetic layer 12 to expose the end surfaces of the columnar wirings 31, 32 and the external terminals 41, 42. With the coating film 50, the insulation of the surface of the inductor component 1 can be ensured. The coating film 50 may be formed on the lower surface side of the first magnetic layer 11.

According to the inductor component 1, laminated objects such as the second magnetic layer 12 and the spiral wiring 21 above the second principal surface 61*b* can be formed on the second principal surface 61*b* of the stable substrate 61 that is a sintered body, and therefore, the formation accuracy of the laminated objects can be improved. Since the first principal surface 61*a* is in close contact with the first magnetic layer 11, the spiral wiring 21 is not formed on the first principal surface 61*a*. As a result, even if the thickness of the substrate 61 is ensured to some extent so as to improve the formation accuracy of the laminated objects, the substrate 61 can be processed by polishing etc. from the first principal surface 61*a* side, so that the thickness can be reduced after the laminated objects are formed on the second principal surface 61*b*. Therefore, both the formation accuracy and the height reduction of the inductor component 1 can be achieved.

Additionally, since the substrate 61 is not completely removed, the laminated objects such as the spiral wiring 21, the second magnetic layer 12, and the insulating layer 15 can be protected from the processing, and mass-production variations in Rdc etc. can be suppressed.

Furthermore, by adding a processing amount of the substrate 61 as an adjustment element to a manufacturing process, a degree of design freedom can be improved in terms of the strength, L, height dimension, etc. of the inductor component 1, and the mass-production variations thereof can be reduced.

The insulating layer 15 is directly disposed on the second principal surface 61*b* of the substrate 61, and the spiral wiring 21 is formed on the insulating layer 15. As a result, the insulating layer 15 is interposed between the spiral wiring 21 and the second principal surface 61*b*, so that the insulation of the spiral wiring 21 is improved on the second principal surface 61*b* side.

The spiral wiring 21 is covered with the insulating layer 15. As a result, the spiral wiring 21 is covered with the insulating layer 15, and the insulation of the spiral wiring 21 is further improved. In this embodiment, the insulating layer 15 with the spiral wiring 21 formed thereon and the insulating layer 15 covering the spiral wiring 21 are integrated; however, for example, a second insulating layer covering the spiral wiring 21 may further be included separately from the insulating layer with the spiral wiring 21 formed thereon.

Preferably, the substrate 61 is a magnetic substance. As a result, a region of the magnetic substance is increased in the inductor component 1, so that L can be improved.

Preferably, the first and second magnetic layers 11, 12 contain a metal magnetic powder contained in a resin, and the substrate 61 is a sintered body of ferrite. As a result, DC superimposition characteristics can be improved by the first magnetic layer 11 and the second magnetic layer 12 containing the metal magnetic powder.

Preferably, the first and second magnetic layers 11, 12 further contain a ferrite powder. As a result, the effective magnetic permeability, i.e., the magnetic permeability per volume of the first and second magnetic layers 11, 12, can be improved by containing not only the metal magnetic powder but also the ferrite having a high relative magnetic permeability.

Preferably, the sum of the thickness of the first magnetic layer 11 and the thickness of the second magnetic layer 12 is larger than the thickness of the substrate 61. In other words, the sum of the volume of the first magnetic layer 11 and the volume of the second magnetic layer 12 is larger than the volume of the substrate 61. As a result, since the proportion of the magnetic layers 11, 12 containing a relatively soft resin becomes large, the stress absorbability of the inductor component 1 is improved, and an influence of thermal shock, external pressure, etc. can be reduced, so that the reliability of the inductor component 1 is improved. Additionally, if the first and second magnetic layers 11, 12 contain the metal magnetic powder, the DC superimposition characteristics of the inductor component 1 can be improved.

Preferably, the thickness of the first magnetic layer 11 and the thickness of the second magnetic layer 12 are both greater than the thickness of the substrate 61. As a result, since the proportion of the magnetic layers 11, 12 containing a relatively soft resin becomes larger, the stress absorbability of the inductor component 1 is further improved, and an influence of thermal shock, external pressure, etc. can be reduced, so that the reliability of the inductor component 1 is further improved. Additionally, if the first and second magnetic layers 11, 12 contain the metal magnetic powder, the DC superimposition characteristics of the inductor component 1 can further be improved.

Preferably, the electrical resistivity of the first magnetic layer 11 and the electrical resistivity of the second magnetic layer 12 are higher than the electrical resistivity of the substrate 61. As a result, an iron loss, i.e., a loss due to a material, can be reduced by including a portion having a high electrical resistivity.

Specifically, a method of measuring the electrical resistivity in the present application may include: forming an electrode of a gallium-indium alloy on an object to be measured taken out by polishing or cutting; measuring an electrical resistance at an applied voltage of 1.0 V at room temperature by using an insulation resistance meter; and making a calculation based on a formed electrode area and an interelectrode distance with the following equation: electrical resistivity (Ω·m)=electrical resistance (Ω)×(electrode area ($m^2$)/interelectrode distance (m). An object to be measured in a material state may be hardened by applying pressure, heat, etc., before measurement. For example, the electrical resistivity of the first magnetic layer 11 and the second magnetic layer 12 is on the order of $1.0\times10^{11\ to\ 12}$ Ω·m, and the electrical resistivity of the substrate 61 is on the order of $1.0\times10^{9\ to\ 10}$ Ω·m.

Preferably, the substrate 61 has a crack portion 61*d*. The crack portion 61*d* is formed by fracture inside the substrate 61. As a result, a stress is released in the crack portion 61*d*, and the impact resistance of the inductor component 1 is improved.

Preferably, the spiral wiring 21 has a spiral-shaped first conductor layer, and a second conductor layer disposed on the first conductor layer and shaped along the first conductor layer, and the thickness of the first conductor layer is 0.5 μm or more. As a result, the unevenness of the substrate 61 can be absorbed by the thickness of the first conductor layer, and the formation and processing of the second conductor layer are facilitated, so that the formation accuracy of the inductor component 1 is improved.

Preferably, the spiral wiring 21 has a spiral-shaped first conductor layer and a second conductor layer disposed on the first conductor layer and shaped along the first conductor layer, and the Ni content percentage of the first conductor layer is 5.0 wt % or less. As a result, a difference can be reduced between the electric conductivity of the first conductor layer and the electric conductivity of the second conductor layer, and the current flowing through the spiral wiring 21 flows substantially uniformly in cross sections of the first conductor layer and the second conductor layer, so that heat generation can be made uniform in the spiral wiring 21. Additionally, Rdc of the spiral wiring 21 is reduced. In this case, it can be said that a first conductor layer 211 is not formed by electroless plating.

As described above, if the first conductor layer is not formed by electroless plating, the first magnetic layer 11 can be prevented from being affected by a process of applying a catalyst to the first magnetic layer 11, an electroless plating process (a seed layer forming step), and a process of etching a conductor layer formed by electroless plating (a seed layer removing step). Specifically, the first magnetic layer 11 contains a magnetic powder, and the magnetic powder can be restrained from being removed by a plating solution, an etching solution, etc. used in a pretreatment or a process at the time of formation of the first conductor layer. Therefore, as described above, if the first conductor layer has a feature that the layer is not formed by electroless plating, the first magnetic layer 11 can be prevented from decreasing in magnetic permeability and decreasing in strength.

In a method of measuring the Ni content percentage, after performing a pretreatment for making a boundary between the first conductor layer and the second conductor layer clear as needed, the Ni content percentage (wt %) on the first conductor layer side is calculated by performing EDX analysis with a scanning transmission electron microscope (STEM). Regarding the pretreatment, for example, a wiring having the first conductor layer and the second conductor layer may be exposed on a cross section by polishing or milling, and the cross section may thinly be etched by dry etching with Ar or wet etching with nitric acid so that the boundary between the first conductor layer and the second conductor layer thereby becomes clearer due to a difference in etching rate. However, regardless of the presence/absence of the pretreatment, the first conductor layer may be determined from a continuity and a particle size of particles by STEM. The EDX analysis may be performed by using, for example, JEM-2200FS manufactured by JEOL as STEM and Noran System 7 manufactured by Thermo Fisher Scientific as an EDX system at the magnification of 400 k (magnification of 400 k or more as needed).

Figure 2:
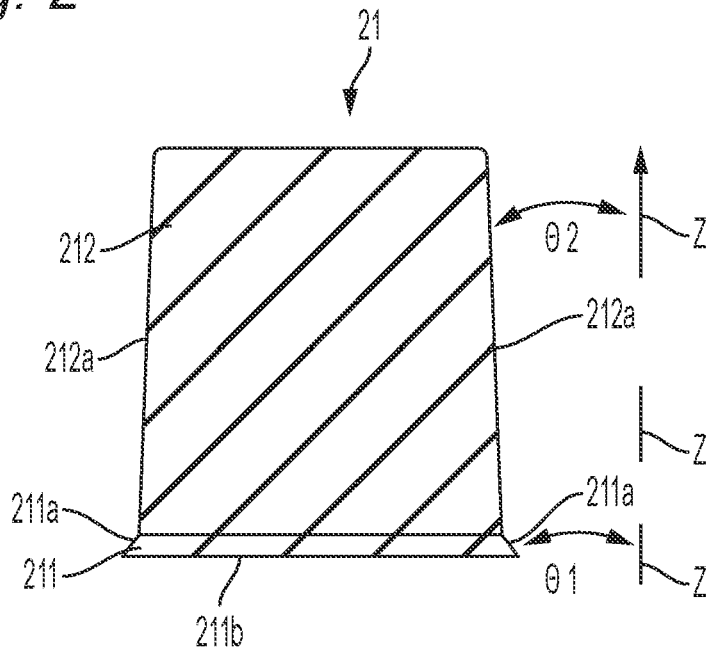
FIG. 2 is an enlarged cross-sectional view showing a preferable form of a spiral wiring.

Preferably, as shown in FIG. 2, the spiral wiring 21 has the spiral-shaped first conductor layer 211 and a second conductor layer 212 disposed on the first conductor layer 211 and shaped along the first conductor layer 211. A taper angle θ1 of a side surface 211*a* of the first conductor layer 211 is larger than a taper angle θ2 of a side surface 212*a* of the second conductor layer 212. The side surface 211*a* of the first conductor layer 211 refers to a surface in the width direction of the first conductor layer 211, and the side surface 212*a* of the second conductor layer 212 refers to a surface in the width direction of the second conductor layer 212. As a result, the spiral wiring 21 is forward tapered so that the second magnetic layer 12 can easily be filled between wirings of the spiral wiring 21.

For example, the taper angle θ1 of the side surface 211*a* of the first conductor layer 211 is 30.0°, and the taper angle θ2 of the side surface 212*a* of the second conductor layer 212 is 1.2°. In this case, based on the Z direction (0°), the angle is positive when a taper shape is formed, and the angle is negative when a reverse taper shape is formed. The taper angle may accurately be measured in a region of 80% excluding upper/lower 20% of the thickness of each of the first conductor layer 211 and the second conductor layer 212.

Preferably, the line width of the first conductor layer 211 is different from the line width of the second conductor layer 212. The line width of the first conductor layer 211 refers to the maximum value of the width of the first conductor layer 211, and the line width of the second conductor layer 212 refers to the maximum value of the width of the second conductor layer 212. As a result, a combination of formation methods of conductor layers forming various shapes can be employed, which increases a degree of design freedom of the spiral wiring 21.

The line width of the first conductor layer 211 is preferably larger than the line width of the second conductor layer 212 and, as a result, the spiral wiring 21 has a forward tapered shape widened on the bottom surface side and narrowed on the top side, so that the second magnetic layer 12 is easily filled in the vicinity of the side surfaces of the spiral wiring 21.

The present disclosure is not limited to the relationships of the line width and the taper angle of FIG. 2 and, for example, the line width or the taper angle of the first conductor layer 211 may be smaller than the line width or taper angle of the second conductor layer 212.

The substrate 61 may be provided with a hole portion at a position corresponding to the inner circumferential portion of the spiral wiring 21 so that either or both of the first magnetic layer 11 and the second magnetic layer 12 can be disposed in the hole portion of the substrate 61, and since an increase in proportion of the first and second magnetic layers 11, 12 containing the relatively soft resin improves the stress absorbability of the inductor component 1 so that the influence of thermal shock, external pressure, etc. can be reduced, the reliability of the inductor component 1 can be improved. Additionally, if the first magnetic layer 11 and the second magnetic layer 12 contain the metal magnetic powder, the DC superimposition characteristics of the inductor component 1 can be improved.

The substrate 61 may have a shape along the spiral shape of the spiral wiring 21, and since a reduction in proportion of the substrate 61 in the inductor component 1 increases the proportion of the first and second magnetic layers 11, 12 containing the relatively soft resin, the stress absorbability of the inductor component 1 is improved so that the influence of thermal shock, external pressure, etc. can be reduced, and therefore, the reliability of the inductor component 1 can be improved. Additionally, if the first magnetic layer 11 and the second magnetic layer 12 contain the metal magnetic powder, the DC superimposition characteristics of the inductor component 1 can be improved.

A vertical wiring may be disposed such that the wiring is led out from the spiral wiring 21 to the lower surface of the inductor component 1. In this case, an external terminal connected to the vertical wiring may be disposed on the lower surface of the inductor component 1. This can improve a degree of freedom of connection between the inductor component 1 and another circuit component.

Although the inductor component 1 has the one spiral wiring 21, the present disclosure is not limited to this configuration, and the inductor component 1 may include two or more spiral wirings wound on the same plane. Since the inductor component 1 has a high degree of freedom in terms of formation of external terminals, the effect thereof is more prominent in the inductor component having a larger number of external terminals.

(Manufacturing Method)

A manufacturing method of the inductor component 1 will be described.

Figure 3A:
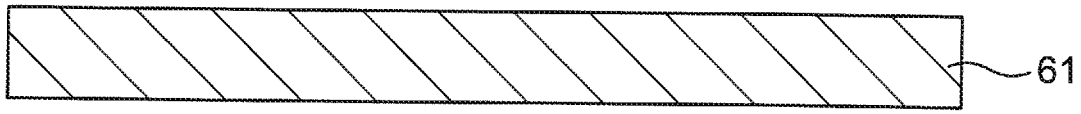
FIG. 3A is an explanatory view for explaining a manufacturing method of the inductor component according to the first embodiment.

As shown in FIG. 3A, the substrate 61 is prepared. The substrate 61 is a flat plate-shaped substrate made of sintered ferrite, for example. Since the thickness of the substrate 61 does not affect the thickness of the inductor component, the substrate with easy-to-handle thickness may appropriately be used for the reason of warpage due to processing etc.

Figure 3B:
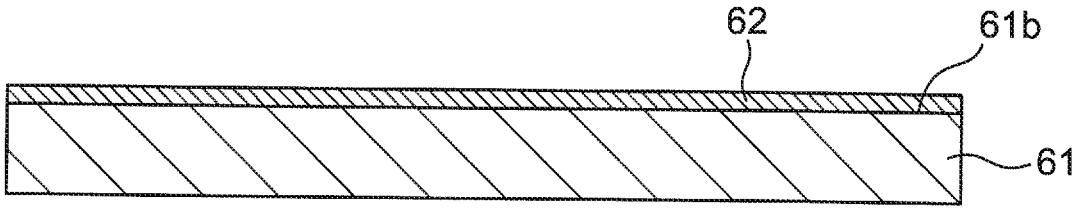
FIG. 3B is an explanatory view for explaining a manufacturing method of the inductor component according to the first embodiment.

As shown in FIG. 3B, an insulating layer 62 containing no magnetic substance is formed on the substrate 61. The insulating layer 62 is made of, for example, a polyimide resin containing no magnetic substance and is formed by coating with the polyimide resin on the upper surface (the second principal surface 61*b*) of the substrate 61 by printing, application, etc. The insulating layer 62 may be formed as a thin film of an inorganic material such as a silicon oxide film by a dry process such as vapor deposition, sputtering, and CVD on the upper surface of the substrate 61, for example.

Figure 3C:
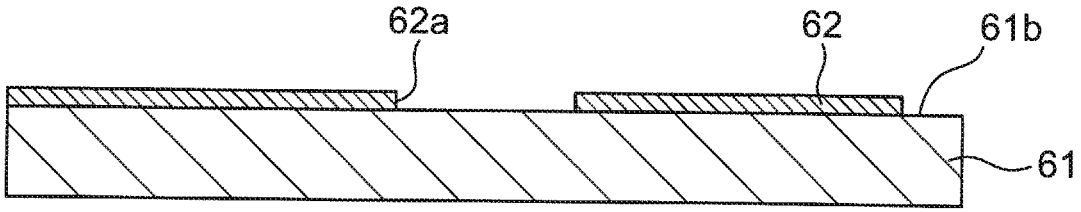
FIG. 3C is an explanatory view for explaining a manufacturing method of the inductor component according to the first embodiment.
Figure 3D:
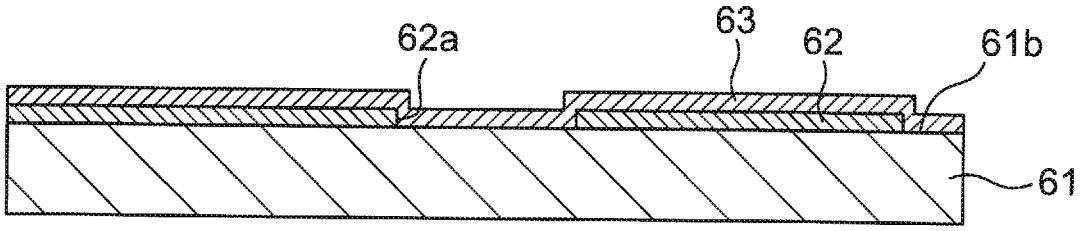
FIG. 3D is an explanatory view for explaining a manufacturing method of the inductor component according to the first embodiment.

As shown in FIG. 3C, the insulating layer 62 is patterned by photolithography to leave a region for forming the spiral wiring. Specifically, the insulating layer 62 is removed while leaving a portion along the spiral wiring. The insulating layer 62 is provided with an opening 62*a* through which the substrate 61 is exposed. As shown in FIG. 3D, a seed layer 63 of Cu is formed on the substrate 61 including the insulating layer 62 by sputtering, electroless plating, etc. The seed layer 63 may be formed on another substrate by electrolytic plating and transferred to the substrate 61.

Figure 3E:
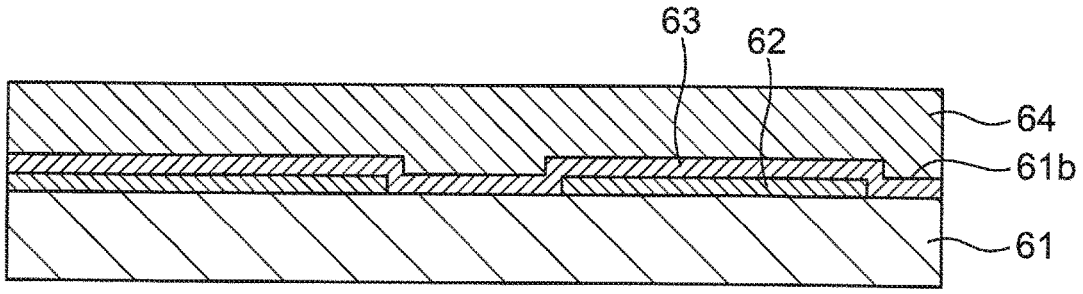
FIG. 3E is an explanatory view for explaining a manufacturing method of the inductor component according to the first embodiment.
Figure 3F:
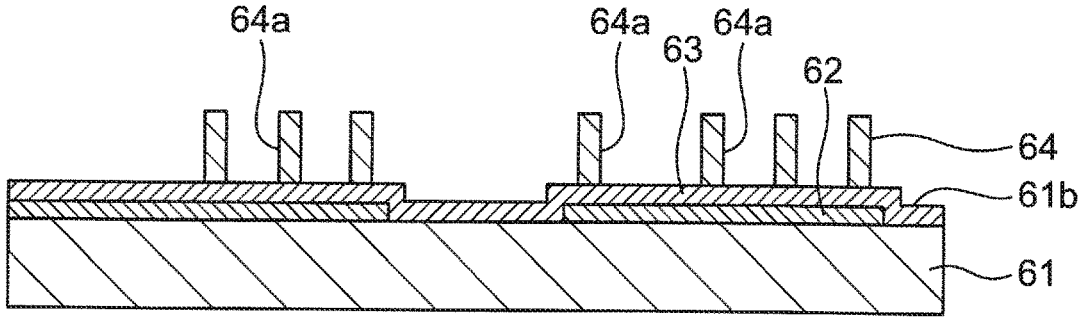
FIG. 3F is an explanatory view for explaining a manufacturing method of the inductor component according to the first embodiment.

As shown in FIG. 3E, a dry film resist (DFR) 64 is affixed onto the seed layer 63. As shown in FIG. 3F, the DFR 64 is patterned by photolithography to form a through-hole 64*a* in a region for forming the spiral wiring 21, so that the seed layer 63 is exposed from the through-hole 64*a*.

Figure 3G:
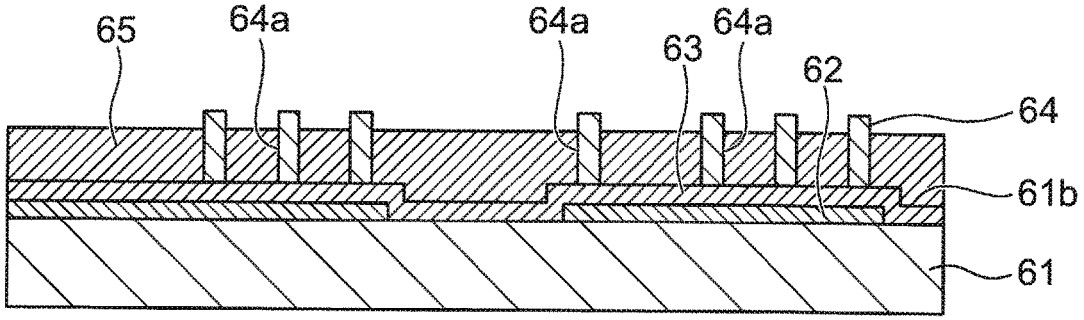
FIG. 3G is an explanatory view for explaining a manufacturing method of the inductor component according to the first embodiment.
Figure 3H:
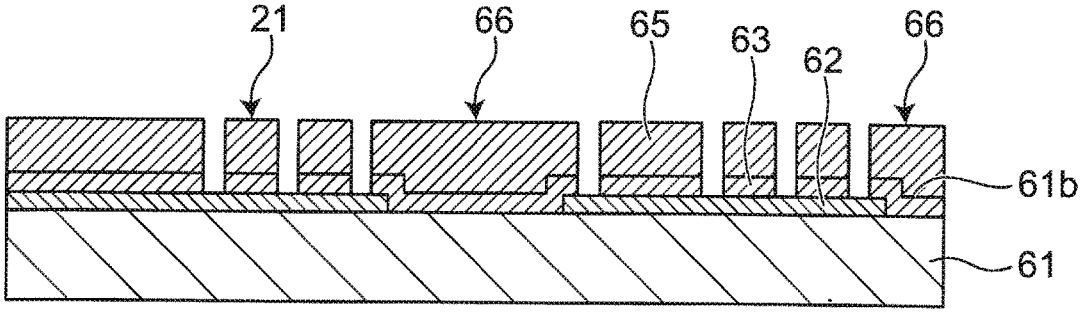
FIG. 3H is an explanatory view for explaining a manufacturing method of the inductor component according to the first embodiment.

As shown in FIG. 3G, a metal film 65 is formed on the seed layer 63 in the through-hole 64*a* by electroplating. As shown in FIG. 3H, after formation of the metal film 65, the DFR 64 is removed, and the seed layer 63 is removed by etching in an exposed portion on which the metal film 65 is not formed. As a result, the spiral wiring 21 is formed, and a sacrificial conductor layer 66 is formed at a position corresponding to the inner circumferential portion and the outer circumferential portion of the spiral wiring 21.

Figure 3I:
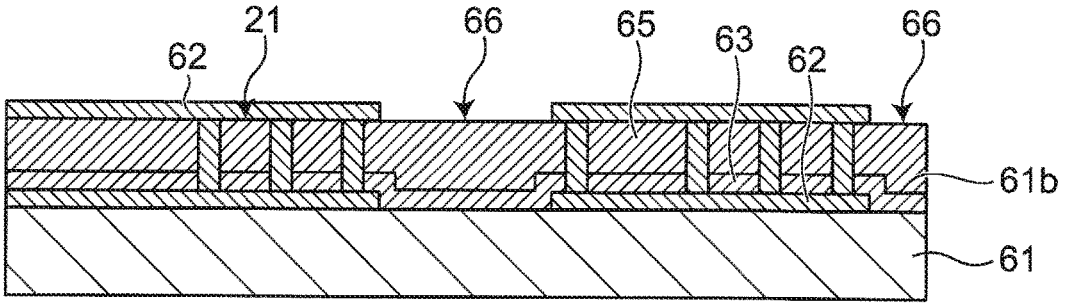
FIG. 3I is an explanatory view for explaining a manufacturing method of the inductor component according to the first embodiment.
Figure 3J:
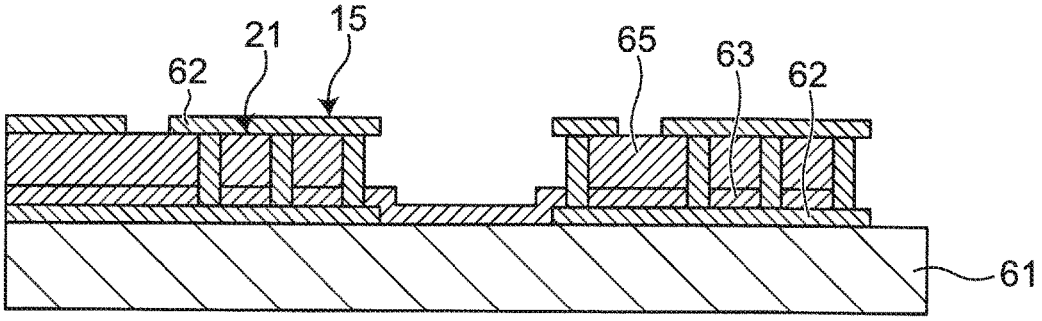
FIG. 3J is an explanatory view for explaining a manufacturing method of the inductor component according to the first embodiment.

As shown in FIG. 3I, the insulating layer 62 is further formed, and as in FIG. 3C, the insulating layer 62 is removed in a region overlapping with the inner circumferential portion and the outer circumferential portion of the spiral wiring 21. As shown in FIG. 3J, the sacrificial conductor layer 66 is removed. Subsequently, in this case, the insulating layers 62 on both end portions of the spiral wiring 21 are also removed. As a result, the spiral wiring 21 is covered with the insulating layer 15 (insulating layer 62). Therefore, the spiral wiring 21 has the seed layer 63 as the first conductor layer and the metal film 65 as the second conductor layer. The metal film 65 has a spiral shape along the seed layer 63.

Figure 3K:
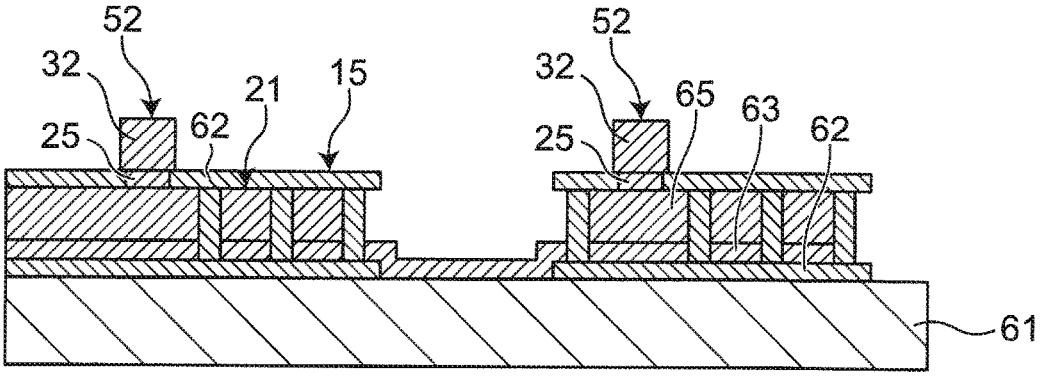
FIG. 3K is an explanatory view for explaining a manufacturing method of the inductor component according to the first embodiment.

As shown in FIG. 3K, the via conductors 25 and the first and second columnar wirings 31, 32 are formed as in FIGS. 3D to 3H. As a result, the first and second vertical wirings 51, 52 are formed.

Figure 3L:
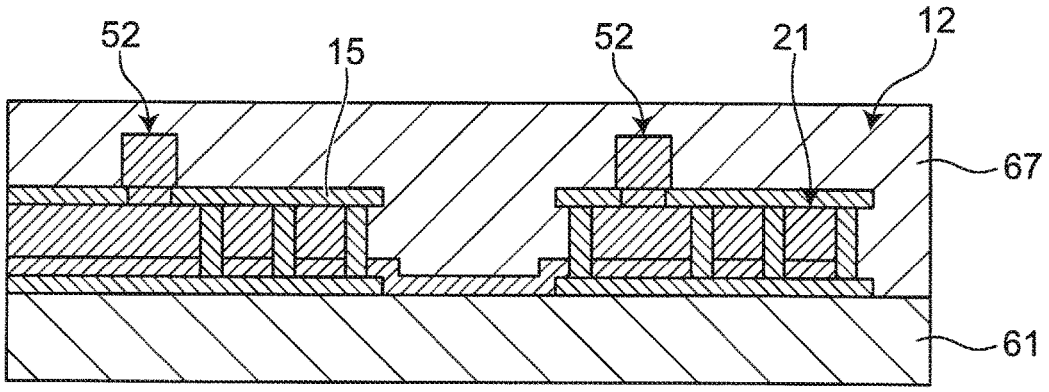
FIG. 3L is an explanatory view for explaining a manufacturing method of the inductor component according to the first embodiment.

As shown in FIG. 3L, a magnetic sheet 67 made of a magnetic material is pressure-bonded to the upper-surface side (spiral wiring formation side) of the substrate 61. As a result, the second magnetic layer 12 is formed on the second principal surface 61*b* side of the substrate 61.

Figure 3M:
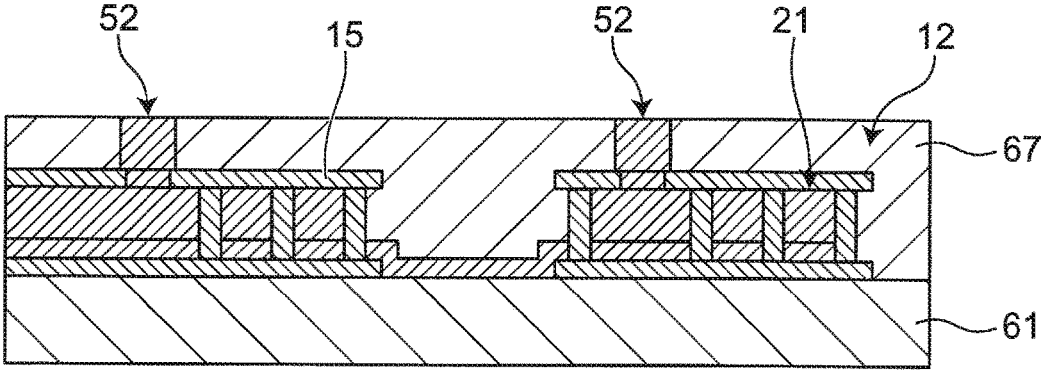
FIG. 3M is an explanatory view for explaining a manufacturing method of the inductor component according to the first embodiment.
Figure 3N:
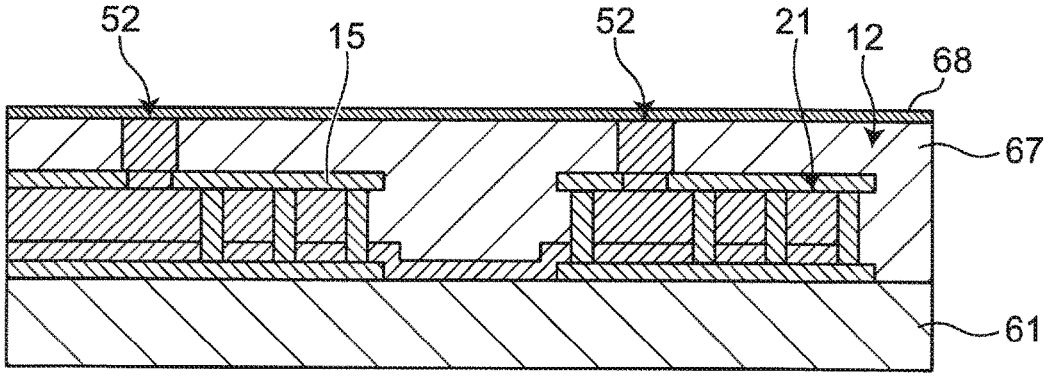
FIG. 3N is an explanatory view for explaining a manufacturing method of the inductor component according to the first embodiment.

As shown in FIG. 3M, the magnetic sheet 67 is polished to expose upper ends of the vertical wirings 51, 52 (the columnar wirings 31, 32. As shown in FIG. 3N, a solder resist (SR) 68 is formed as the coating film 50 on the upper surface of the magnetic sheet 67.

Figure 3O:
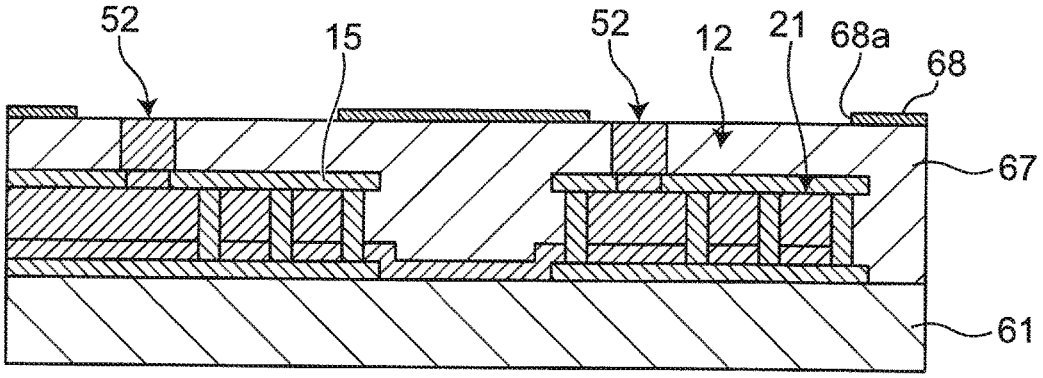
FIG. 3O is an explanatory view for explaining a manufacturing method of the inductor component according to the first embodiment.

As shown in FIG. 3O, the SR 68 is patterned by photolithography to form through-holes 68*a* through which the first and second vertical wirings 51, 52 and the second magnetic layer 12 (the magnetic sheet 67) are exposed, in a region for forming external terminals.

Figure 3P:
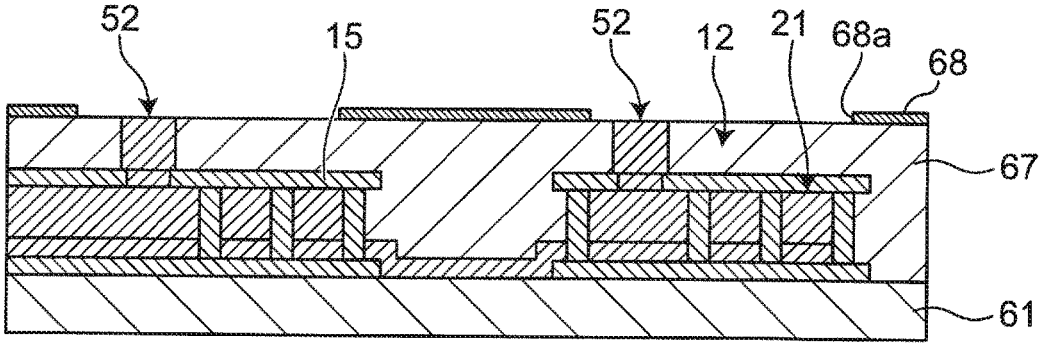
FIG. 3P is an explanatory view for explaining a manufacturing method of the inductor component according to the first embodiment.
Figure 3Q:
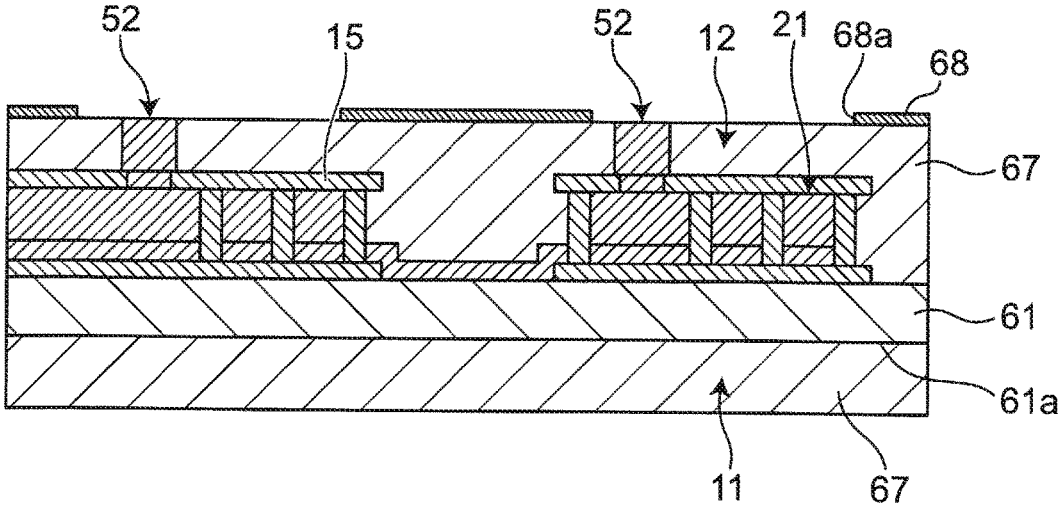
FIG. 3Q is an explanatory view for explaining a manufacturing method of the inductor component according to the first embodiment.

As shown in FIG. 3P, the substrate 61 is polished from the first principal surface 61*a* side. In this case, the substrate 61 is not completely removed and is partially left. As shown in FIG. 3Q, the magnetic sheet 67 made of a magnetic material is pressure-bonded to the first principal surface 61*a* on the polished side of the substrate 61 and is polished to an appropriate thickness.

Figure 3R:
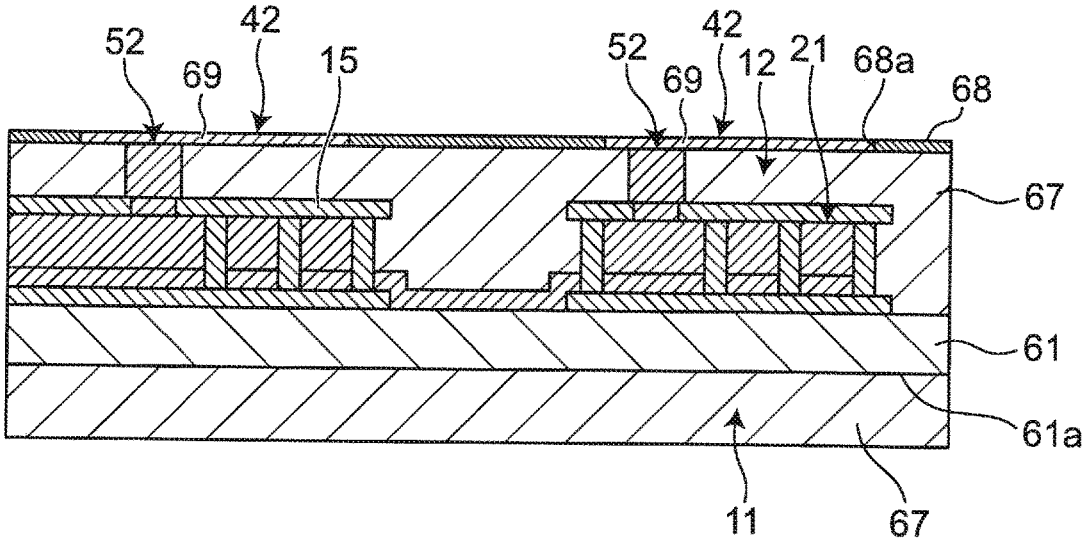
FIG. 3R is an explanatory view for explaining a manufacturing method of the inductor component according to the first embodiment.
Figure 3S:
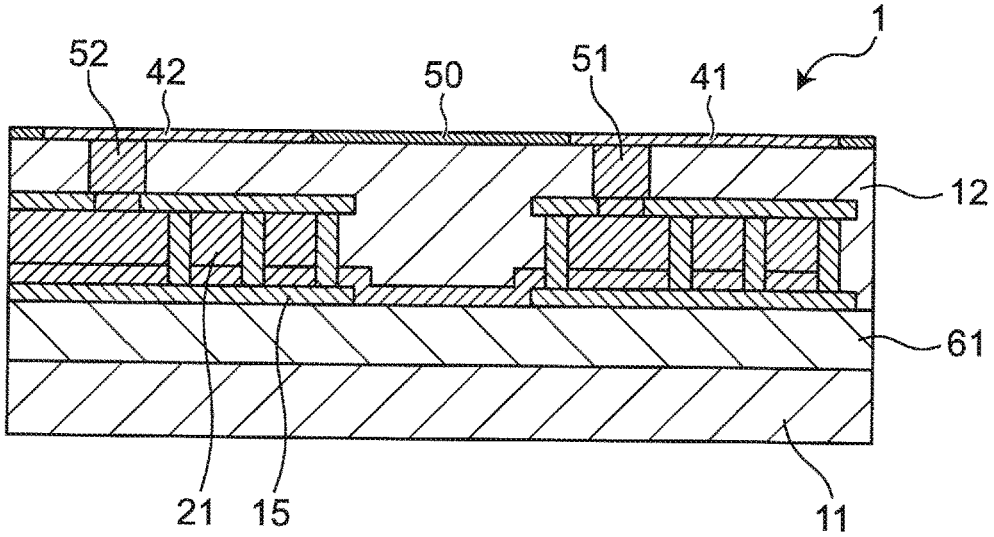
FIG. 3S is an explanatory view for explaining a manufacturing method of the inductor component according to the first embodiment.

As shown in FIG. 3R, a metal film 69 of Cu/Ni/Au is formed by electroless plating and grown from the vertical wirings 51, 52 into the through-holes 68*a* of the SR 68. The metal film 69 forms the first external terminal 41 connected to the first vertical wiring 51 and the second external terminal 42 connected to the second vertical wiring 52. As shown in FIG. 3S, individual pieces are formed and subjected to barrel polishing as needed, and burrs are removed to manufacture the inductor component 1.

The manufacturing method of the inductor component 1 is merely an example, and techniques and materials used in steps may appropriately be replaced with other known techniques and materials. For example, although the insulating layer 62, the DFR 64, and the SR 68 are patterned after coating in the above description, the insulating layer 62 may directly be formed on necessary portions by application, printing, mask vapor deposition, lift-off, etc. Although polishing is used for removal of the substrate 61 and thinning of the magnetic sheet 67, another physical process such as blasting and laser or a chemical process such as hydrofluoric acid treatment may be used.

Second Embodiment

Figure 4:
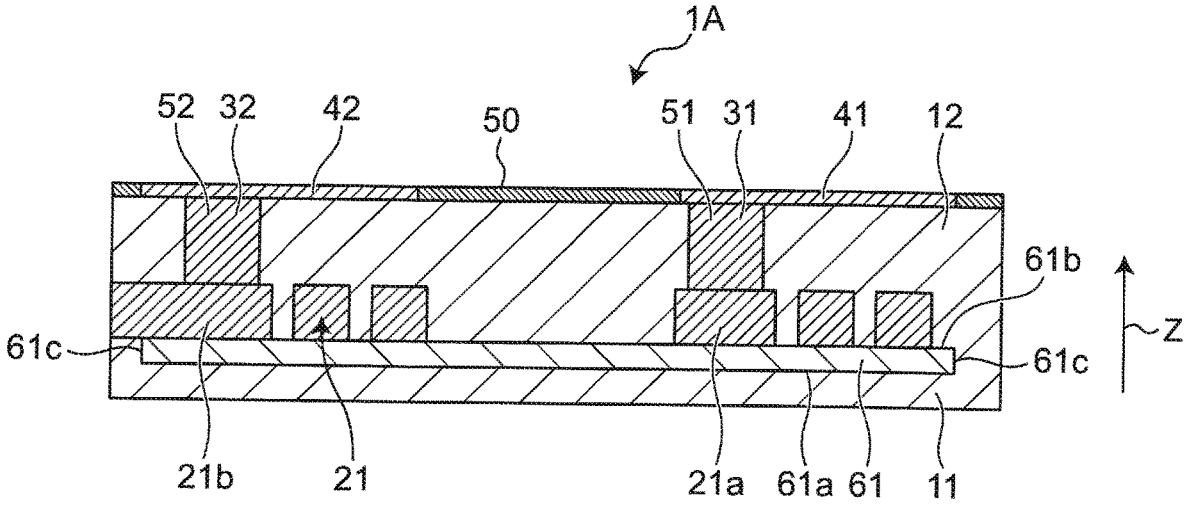
FIG. 4 is a cross-sectional view showing an inductor component according to a second embodiment.

FIG. 4 is a cross-sectional view showing a second embodiment of an inductor component. The second embodiment is different from the first embodiment in configuration of the insulating layer and the magnetic layer. This different configuration will hereinafter be described. The other constituent elements have the same configuration as the first embodiment and are denoted by the same reference numerals as the first embodiment and will not be described.

As shown in FIG. 4, as compared to the inductor component 1 of the first embodiment, an inductor component 1A of the second embodiment does not include the insulating layer 15 of the first embodiment, and the substrate 61 is covered with the magnetic layers 11, 12.

Specifically, a side surface 61*c* connecting the first principal surface 61*a* and the second principal surface 61*b* of the substrate 61 is covered with the first magnetic layer 11 or the second magnetic layer 12. As a result, since the proportion of the magnetic layers 11, 12 containing a relatively soft resin becomes larger, the stress absorbability of the inductor component 1A is improved, and an influence of thermal shock, external pressure, etc. can be reduced, so that the reliability of the inductor component 1A is improved. Additionally, when if the magnetic layers 11, 12 contain the metal magnetic powder, the DC superimposition characteristics of the inductor component 1A can be improved. The side surface 61*c* may entirely be covered by the magnetic layers 11, 12, or the side surface 61*c* may at least partially be covered with the magnetic layers 11, 12.

The spiral wiring 21 is directly disposed on the second principal surface 61*b* of the substrate 61. Therefore, the second principal surface 61*b* is in close contact with the spiral wiring 21. As a result, since no other constituent element such as the insulating layer 15 is interposed between the spiral wiring 21 and the second principal surface 61*b* of the substrate 61, the characteristics such as L and Rdc can be improved in the same volume or the height can be reduced while maintaining the same characteristics.

In this embodiment, the second magnetic layer 12 is also directly disposed on the second principal surface 61*b* of the substrate 61 including the spiral wiring 21. Therefore, the spiral wiring 21 is in close contact with the second magnetic layer 12. As a result, since no other constituent element such as the insulating layer 15 is interposed between the spiral wiring 21 and the second magnetic layer 12, the characteristics such as L and Rdc can be improved in the same volume or the height can be reduced while maintaining the same characteristics.

Since the second magnetic layer 12 is in close contact with the spiral wiring 21 without the insulating layer 15, the vertical wirings 51, 52 do not include the via conductors 25 penetrating the inside of the insulating layer 15. Therefore, the spiral wiring 21 is directly connected to the columnar wirings 31, 32 penetrating the inside of the second magnetic layer 12. As a result, interfaces can be reduced in the vertical wirings 51, 52, and connection reliability can be improved. Since the via conductors 25 having a cross-sectional area smaller than the columnar wirings 31, 32 are not included, Rdc of the inductor component 1A can be reduced.

Third Embodiment

Figure 5A:
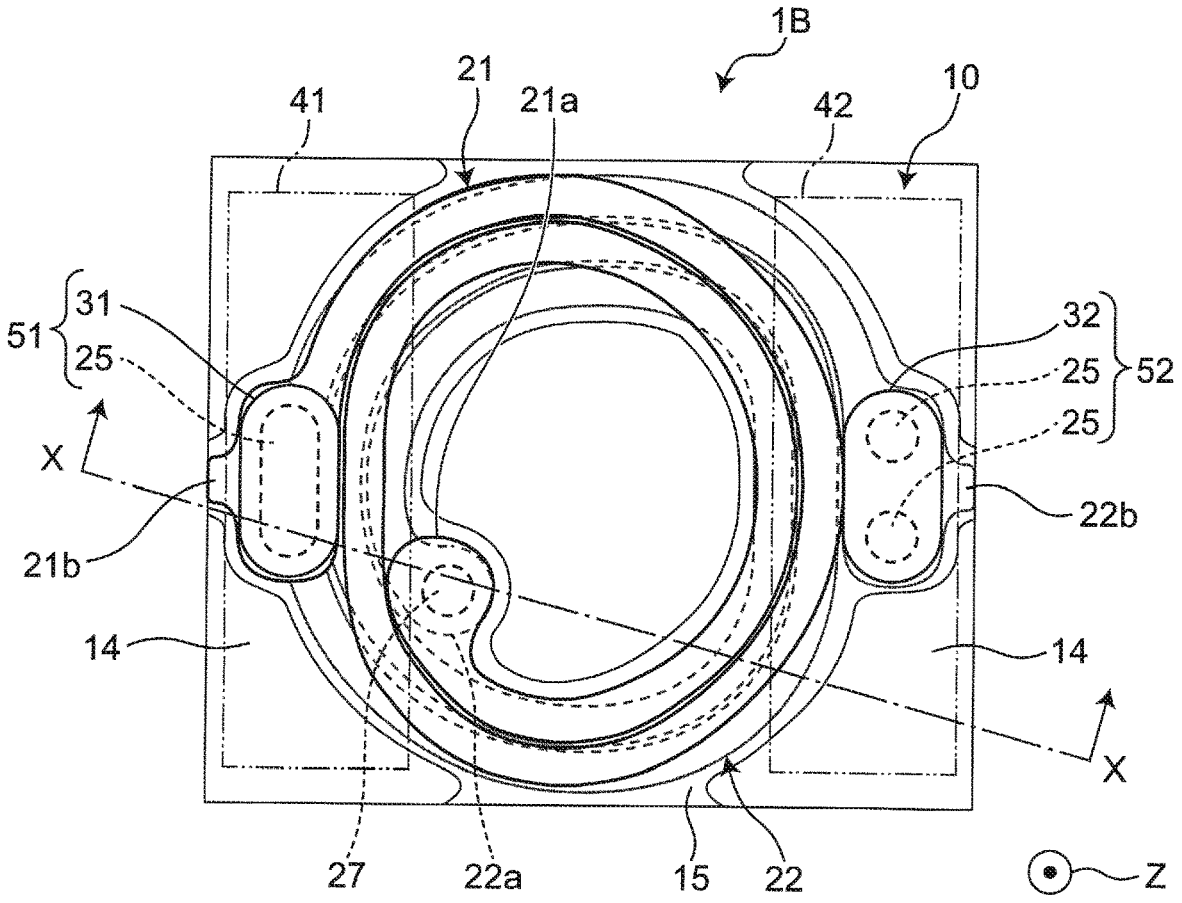
FIG. 5A is a transparent plan view showing an inductor component according to a third embodiment.
Figure 5B:
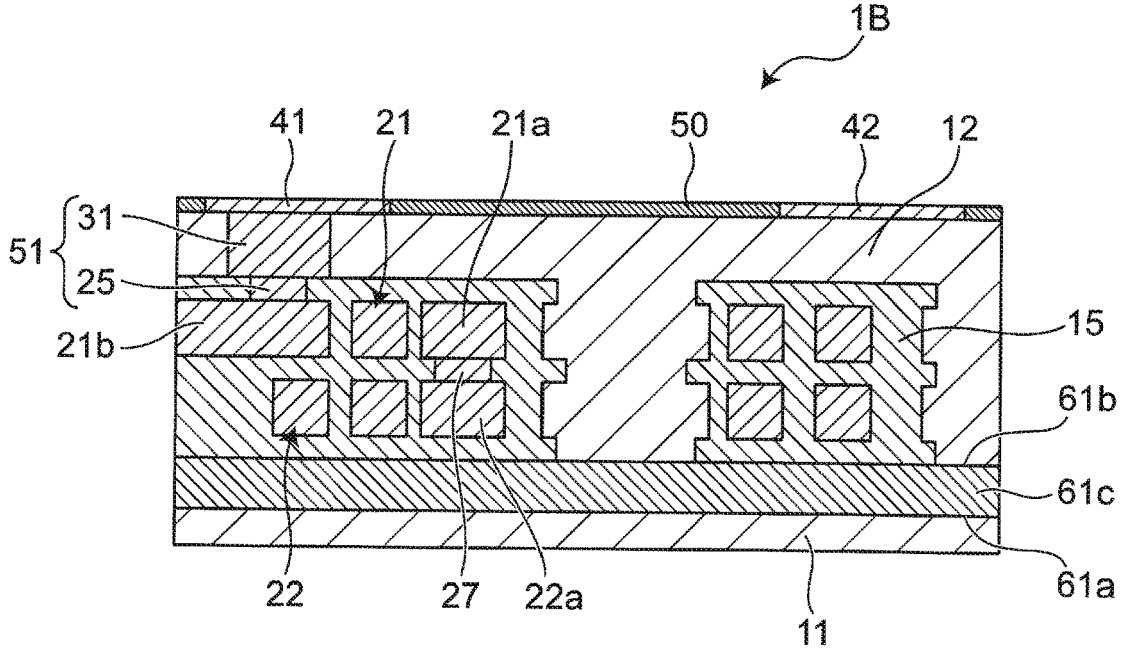
FIG. 5B is a cross-sectional view showing an inductor component according to the third embodiment.

FIG. 5A is a transparent perspective view showing a third embodiment of an inductor component. FIG. 5B is a cross-sectional view taken along a line X-X of FIG. 5A. The third embodiment is different from the first embodiment in the configuration of the spiral wiring. This different configuration will hereinafter be described. In the third embodiment, the same constituent elements as the first embodiment are denoted by the same reference numerals as the first embodiment and therefore will not be described.

As shown in FIGS. 5A and 5B, in an inductor component 1B according to the third embodiment, as compared to the inductor component 1 of the first embodiment, multiple spiral wirings 21, 22 are arranged in the lamination direction, and the multiple spiral wirings 21, 22 are connected in series.

Specifically, the first spiral wiring 21 and the second spiral wiring 22 are laminated in the Z direction. The first spiral wiring 21 is spirally wound in a clockwise direction from the outer circumferential end 21*b* toward the inner circumferential end 21*a* when viewed from the upper side. The second spiral wiring 22 is spirally wound in a clockwise direction from an inner circumferential end 22*a* toward an outer circumferential end 22*b* when viewed from the upper side.

The outer circumferential end 21*b* of the first spiral wiring 21 is connected to the first external terminal 41 through the first vertical wiring 51 (the via conductor 25 and the first columnar wiring 31) on the upper side of the outer circumferential end 21*b*. The inner circumferential end 21*a* of the first spiral wiring 21 is connected to the inner circumferential end 22*a* of the second spiral wiring 22 through the second via conductor 27 on the lower side of the inner circumferential end 21*a*.

The outer circumferential end 22*b* of the second spiral wiring 22 is connected to the second external terminal 42 through the second vertical wiring 52 (via conductors 25, 26 and the second columnar wiring 32) on the upper side of the outer circumferential end 22*b*. Although not shown, the via conductor 26 extends in the Z direction from the via conductor 25 on the upper side of the outer circumferential end 22*b* of the second spiral wiring 22 and penetrates the inside of the insulating layer 15. The via conductor 26 is formed on the same plane as the first spiral wiring 21.

Since the inductor component 1B has the first spiral wiring 21 and the second spiral wiring 22 connected in series, the number of turns can be increased to improve L. Since the first spiral wiring 21 and the second spiral wiring 22 are laminated in the normal direction with each other, an area, i.e., a mounting area, of the inductor component 1B viewed in the Z direction can be reduced with respect to the number of turns, so that the inductor component 1B can be reduced in size.

Although the inductor component 1B has a configuration including two layers of the spiral wirings connected in series, the present disclosure is not limited thereto, and the component may have three or more layers of the spiral wirings connected in series. Although the inductor component 1B has one inductor made up of two layers of the spiral wirings and disposed on the same plane, the component may have two or more inductors disposed on the same plane.

Fourth Embodiment

Figure 6A:
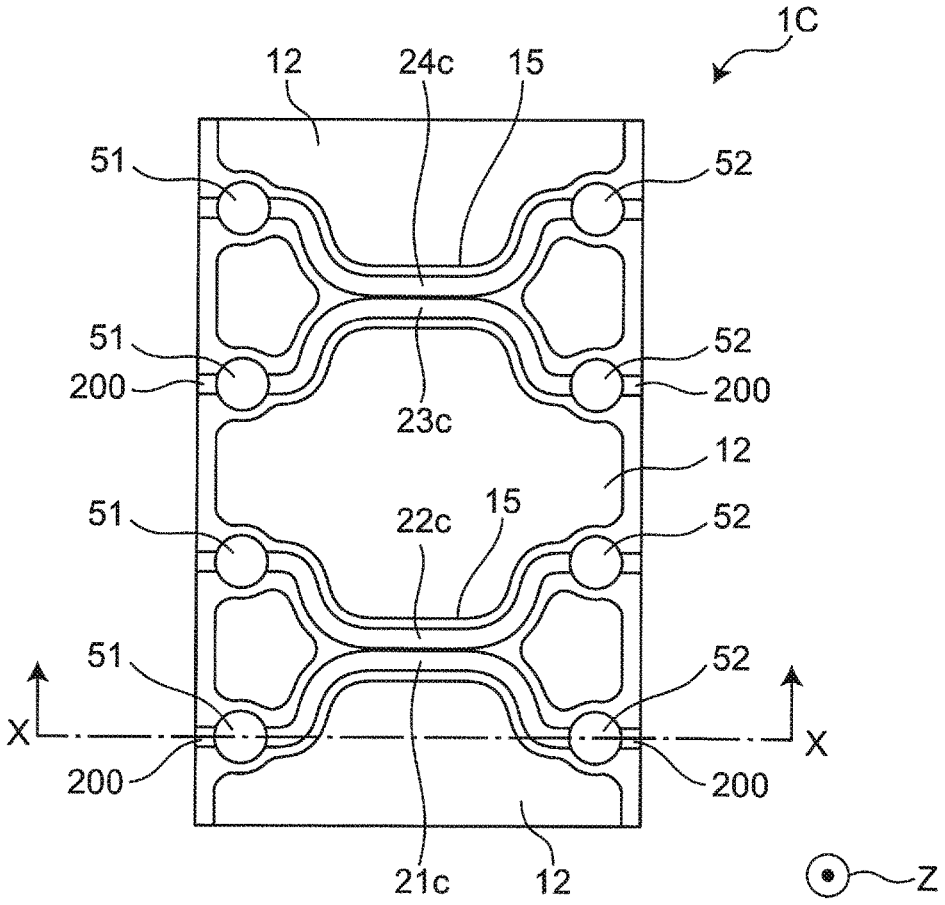
FIG. 6A is a transparent plan view showing an inductor component according to a fourth embodiment.
Figure 6B:
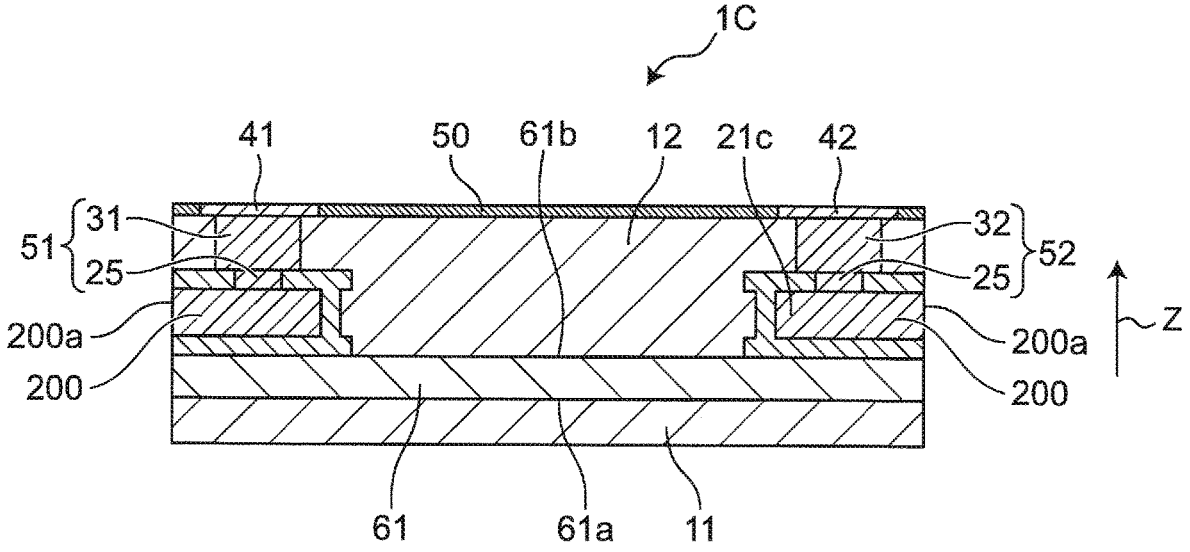
FIG. 6B is a cross-sectional view showing an inductor component according to the fourth embodiment.

FIG. 6A is a transparent perspective view showing a fourth embodiment of an inductor component. FIG. 6B is a cross-sectional view taken along a line X-X of FIG. 6A. The fourth embodiment is different from the first embodiment in the configuration of the spiral wiring. This different configuration will hereinafter be described. In the fourth embodiment, the same constituent elements as the first embodiment are denoted by the same reference numerals as the other embodiments and therefore will not be described.

As shown in FIGS. 6A and 6B, in an inductor component 1C of the fourth embodiment, as compared to the inductor component 1 of the first embodiment, a plurality of spiral wirings 21C to 24C is disposed on the same plane. The first spiral wiring 21C, the second spiral wiring 22C, the third spiral wiring 23C, and the fourth spiral wiring 24C have a semi-elliptical arc shape when viewed in the Z direction. Therefore, each of the first to fourth spiral wirings 21C to 24C is a curved wiring wound around about a half of the circumference. The spiral wirings 21C to 24C each include a linear part in a middle portion.

The first and fourth spiral wirings 21C, 24C each have both ends connected to the first vertical wiring 51 and the second vertical wiring 52 located on the outer side and have a curved shape drawing an arc from the first vertical wiring 51 and the second vertical wiring 52 toward the center side of the inductor component 1C. The second and third spiral wirings 22C, 23C each have both ends connected to the first vertical wiring 51 and the second vertical wiring 52 located on the inner side and have a curved shape drawing an arc from the first vertical wiring 51 and the second vertical wiring 52 toward an edge side of the inductor component 1C.

It is assumed that an inner diameter portion of each of the first to fourth spiral wirings 21C to 24C is defined as an area surrounded by the curve drawn by the spiral wirings 21C to 24C and the straight line connecting both ends of the spiral wirings 21C to 24C. In this case, none of the spiral wirings 21C to 24C have the inner diameter portions overlapping with each other when viewed in the Z direction.

On the other hand, the first and second spiral wirings 21C, 22C are close to each other. Therefore, the magnetic flux generated in the first spiral wiring 21C goes around the adjacent second spiral wiring 22C, and the magnetic flux generated in the second spiral wiring 22C goes around the adjacent first spiral wiring 21C. The same applies to the third and fourth spiral wirings 23C, 24C arranged close to each other. Thus, the first spiral wiring 21C and the second spiral wiring 22C as well as the third spiral wiring 23C and the fourth spiral wiring 24C are respectively magnetically coupled.

When currents flow simultaneously through the first and second spiral wirings 21C, 22C from the ends on the same side to the other ends on the opposite side, the magnetic fluxes strengthen each other. This means that when the ends on the same side of the first spiral wiring 21C and the second spiral wiring 22C are both used as the input side of pulse signals and the other ends on the opposite side are both used as the output side of the pulse signals, the first spiral wiring 21C and the second spiral wiring 22C are positively coupled. On the other hand, for example, when one of the first spiral wiring 21C and the second spiral wiring 22C has one end side used for input and the other end side used for output while the other spiral wiring has one end side used for output and the other end side used for input, the first spiral wiring 21C and the second spiral wiring 22C can be brought into a negatively coupled state. The same applies to the third and fourth spiral wirings 23C, 24C.

The first vertical wiring 51 connected to the one end sides of the first to fourth spiral wirings 21C to 24C and the second vertical wiring 52 connected to the other end sides of the first to fourth spiral wirings 21C to 24C each penetrate the inside of the second magnetic layer 12 and is exposed on the upper surface. The first external terminal 41 is connected to the first vertical wiring 51, and the second external terminal 42 is connected to the second vertical wiring 52.

The first spiral wiring 21C and the second spiral wiring 22C are integrally covered with the insulating layer 15 so that the electrical insulation of the first spiral wiring 21C and the second spiral wiring 22C is ensured. The third spiral wiring 23C and the fourth spiral wiring 24C are integrally covered with the insulating layer 15 so that the electrical insulation of the third spiral wiring 23C and the fourth spiral wiring 24C is ensured.

The inductor component 1C has wirings further extending toward the outside of the chip from the connecting positions of the spiral wirings 21B to 24B for the vertical wirings 51, 52, and these wirings are exposed to the outside of the chip. Therefore, the spiral wirings 21C to 24C have exposed portions 200 exposed to the outside from side surfaces parallel to the lamination direction of the inductor component 1C.

The exposed portions 200 are connected to a power feeding wiring when additional electrolytic plating is performed before singulation after the metal film 65 is formed by electrolytic plating in the method of manufacturing the inductor component 1 described above. Even after the seed layer 63 is removed, additional electrolytic plating can easily be performed with the power feeding wiring, and an inter-wiring distance can further be narrowed between the spiral wirings made up of the seed layer 63 and the metal film 65. Specifically, in the inductor component 1C, the inter-wiring distance between the first and second spiral wirings 21C, 22C and the inter-wiring distance between the third and fourth spiral wirings 23C, 24C can be narrowed by performing the additional electrolytic plating, so that the magnetic coupling can be enhanced.

Since the spiral wirings 21C to 24C have the exposed portions 200, a resistance to electrostatic destruction can be improved at the time of manufacturing. Specifically, in the method of manufacturing the inductor component 1, the exposed portions 200 are connected to a plurality of inductor components through the power feeding wiring before singulation. Therefore, even if static electricity is applied to the wirings in this state, the static electricity can be dispersed through the power feeding wiring and discharged to the ground, so that the resistance to electrostatic destruction can be improved.

Preferably, in the spiral wirings 21C to 24C, a thickness of an exposed surface 200*a* of the exposed portion 200 is equal to or less than the thickness of the spiral wirings 21C to 24C and is 45 μm or more. As a result, since the thickness of the exposed surface 200*a* is equal to or less than the thickness of the spiral wirings 21C to 24C, the proportion of the magnetic layers 11, 12 can be increased, and L can be improved. Additionally, since the thickness of the exposed surface 200*a* is 45 μm or more, occurrence of disconnection can be reduced.

Preferably, the exposed surface 200*a* is an oxide film. As a result, a short circuit can be suppressed between the inductor component 1C and an adjacent component.

In the first to third embodiments, the spiral wiring may be provided with an exposed portion similar to the exposed portion 200 of the fourth embodiment.

Fifth Embodiment

Figure 7A:
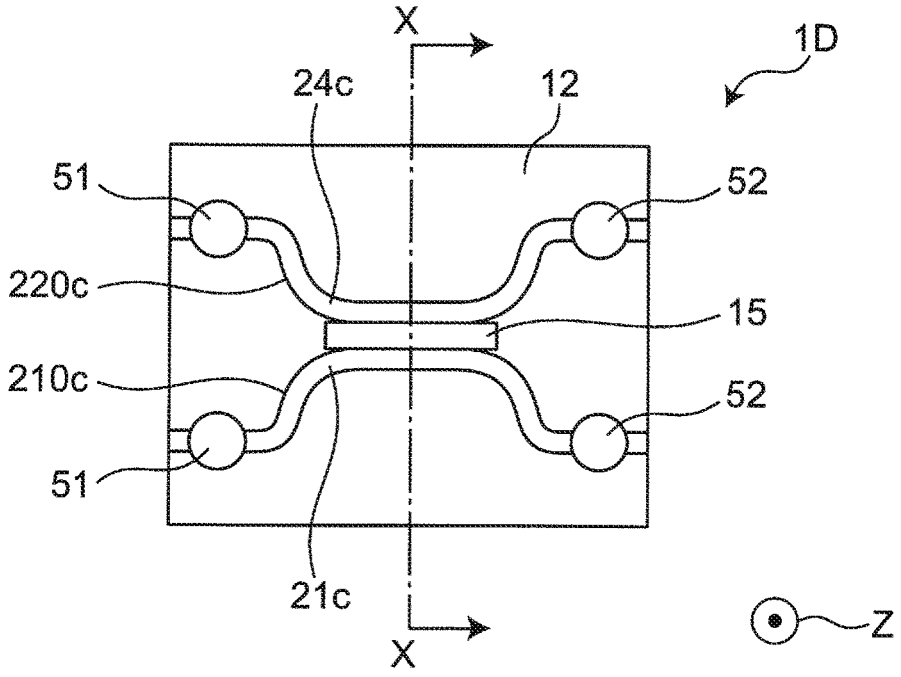
FIG. 7A is a transparent plan view showing an inductor component according to a fifth embodiment.
Figure 7B:
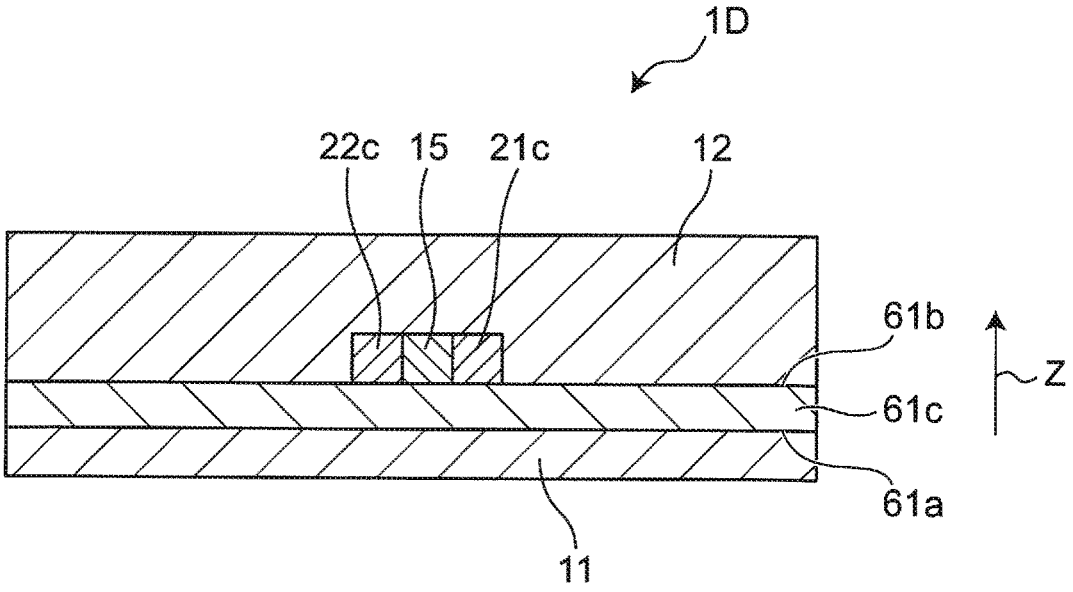
FIG. 7B is a cross-sectional view showing an inductor component according to the fifth embodiment.

FIG. 7A is a transparent perspective view showing a fifth embodiment of an inductor component. FIG. 7B is a cross-sectional view taken along a line X-X of FIG. 7A. The fifth embodiment is different from the fourth embodiment in the configuration of the insulating layer. This different configuration will hereinafter be described. In the fifth embodiment, the same constituent elements as the first embodiment are denoted by the same reference numerals as the other embodiments and therefore will not be described.

As shown in FIGS. 7A and 7B, in the inductor component 1D of the fifth embodiment, as compared to the inductor component 1C of the fourth embodiment, the insulating layer 15 does not entirely cover the circumferences of the spiral wirings 21C, 22C.

Specifically, the adjacent spiral wirings 21C, 22C have side surfaces 210C, 220C facing each other. At least a portion of each of the side surfaces 210C, 220C is in contact with the second magnetic layer 12. As a result, since the second magnetic layer 12 can be increased in amount and the second magnetic layer 12 containing a relatively soft resin can be increased in proportion to improve the stress absorbability of the inductor component 1D so that the influence of thermal shock, external pressure, etc. can be reduced, the reliability of the inductor component 1D can be improved. Additionally, if the second magnetic layer 12 contains the metal magnetic powder, the DC superimposition characteristics of the inductor component 1D can be improved.

The insulating layer 15 is disposed between the adjacent spiral wirings 21C, 22C. As a result, the insulation and voltage resistance between the adjacent spiral wirings 21C, 22C are improved. The insulating layer 15 is located at a minimum distance portion between the adjacent spiral wirings 21C, 22C and is in contact with portions of the side surfaces 210C, 220C. The insulating layer 15 may not be in contact with the side surfaces 210C, 220C, and, for example, the side surface 210C, the second magnetic layer 12, the insulating layer 15, the second magnetic layer 12, and the side surface 220C may be arranged in this order between the adjacent spiral wirings 21C, 22C.

The present disclosure is not limited to the embodiments described above and may be changed in design without departing from the spirit of the present disclosure. For example, respective feature points of the first to fifth embodiments may variously be combined.

In the second embodiment, the spiral wiring 21 is in close contact with both the second principal surface 61*b* of the substrate 61 and the second magnetic layer 12; however, the present disclosure is not limited thereto, and the spiral wiring 21 may be in close contact with only the second principal surface 61*b* or only the second magnetic layer 12, while the insulating layer 15 may be interposed for the other portions. Furthermore, in the second embodiment, the spiral wiring 21 is in close contact with the second magnetic layer 12 on the side surface and the upper surface; however, only one of the side and upper surfaces may be in close contact, while the insulating layer 15 may be interposed for the other surface, or the side surface or the upper surface may only partially and not entirely be in close contact with the second magnetic layer 12, while the insulating layer 15 may be interposed for the other portion.

What is claimed is:

1. An inductor component comprising:

a first magnetic layer and a second magnetic layer containing a resin;

a substrate of a sintered body having a first principal surface in close contact with the first magnetic layer and a second principal surface above which the second magnetic layer is disposed;

a spiral wiring disposed between the second magnetic layer and the substrate;

an insulating layer that directly contacts the sub state and separates the spiral winding from the substrate; and a second insulating layer disposed on the insulating layer, wherein the spiral wiring includes a spiral-shaped first conductor layer and a second conductor layer disposed on the first conductor layer and shaped along the first conductor layer, and a width of a bottom of the first conductor layer is larger than a width of the second conductor layer, a taper angle of a side surface of the first conductor layer is larger than a taper angle of a side surface of the second conductor layer, and the spiral wiring is covered with the second insulating layer, and the side surfaces of the first and second conductor layers are external side surfaces that directly contact the second insulating layer.

2. The inductor component according to claim 1, wherein the substrate is a magnetic substance.

3. The inductor component according to claim 1, wherein the first magnetic layer and the second magnetic layer contain a metal magnetic powder contained in the resin, and wherein the substrate is a sintered body of ferrite.

4. The inductor component according to claim 3, wherein the first magnetic layer and the second magnetic layer further contain a ferrite powder.

5. The inductor component according to claim 1, wherein a sum of the thickness of the first magnetic layer and the thickness of the second magnetic layer is larger than the thickness of the substrate.

6. The inductor component according to claim 5, wherein the thickness of the first magnetic layer and the thickness of the second magnetic layer are both larger than the thickness of the substrate.

7. The inductor component according to claim 1, wherein the electrical resistivity of the first magnetic layer and the electrical resistivity of the second magnetic layer are higher than the electrical resistivity of the substrate.

8. The inductor component according to claim 1, wherein a side surface connecting the first principal surface and the second principal surface of the substrate is at least partially covered with the first magnetic layer or the second magnetic layer.

9. The inductor component according to claim 1, wherein the substrate has a crack portion.

10. The inductor component according to claim 1, wherein the insulating layer is disposed on the second principal surface of the substrate, wherein the spiral wiring is formed on the insulating layer.

11. The inductor component according to claim 1, wherein the spiral wiring is disposed on the second principal surface of the substrate.

12. The inductor component according to claim 1, wherein the first conductor layer has a thickness of 0.5 μm or more.

13. The inductor component according to claim 1, wherein the first conductor layer has a Ni content percentage of 5.0 wt % or less.

14. The inductor component according to claim 1, wherein the spiral wiring is one of a plurality of spiral wirings arranged in a lamination direction, and wherein the plurality of spiral wirings is connected in series.

15. The inductor component according to claim 1, wherein the spiral wiring is one of a plurality of spiral wirings disposed on the same plane, and wherein the spiral wirings adjacent to each other on the same plane include side surfaces facing each other, wherein the side surfaces are at least partially in contact with the second magnetic layer, and wherein an insulating layer is disposed between the spiral wirings adjacent to each other.

16. The inductor component according to claim 1, wherein the spiral wiring includes an exposed portion exposed to the outside from a side surface parallel to the lamination direction of the inductor component.

17. The inductor component according to claim 16, wherein a thickness of an exposed surface of the exposed portion is equal to or less than the thickness of the spiral wiring and is 45 μm or more.

18. The inductor component according to claim 17, wherein the exposed surface is an oxide film.

* * * * *